US006908242B2

(12) United States Patent
Oshima et al.

(10) Patent No.: US 6,908,242 B2
(45) Date of Patent: Jun. 21, 2005

(54) ROLL PAPER CURL CORRECTION DEVICE AND RECORD APPARATUS WITH THE ROLL PAPER CURL CORRECTION DEVICE

(75) Inventors: Keiichi Oshima, Nagano (JP); Hideyuki Kataoka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 118 days.

(21) Appl. No.: 10/206,819

(22) Filed: Jul. 29, 2002

(65) Prior Publication Data

US 2003/0103132 A1 Jun. 5, 2003

(30) Foreign Application Priority Data

Dec. 4, 2001 (JP) ..... P2001-370534
Dec. 4, 2001 (JP) ..... P2001-370543
Dec. 4, 2001 (JP) ..... P2001-370570

(51) Int. Cl.[7] ..... B41J 2/385
(52) U.S. Cl. ..... 400/611; 162/271
(58) Field of Search ..... 271/161, 188; 400/611, 613, 613.1, 619, 617, 613.3; 399/406; 162/271, 270; 226/182

(56) References Cited

U.S. PATENT DOCUMENTS 2,070,505 A * 2/1937 Beck ..... 162/271
3,546,067 A 12/1970 Heidepriem
3,604,652 A * 9/1971 Sleeper ..... 242/419.2
3,971,696 A 7/1976 Manfredi
4,560,990 A * 12/1985 Sue et al. ..... 346/17
5,009,749 A * 4/1991 Cederholm et al. ..... 162/271
5,066,984 A * 11/1991 Coombs ..... 399/406
5,191,379 A 3/1993 Manzer et al.
5,270,778 A * 12/1993 Wyer ..... 399/406
5,300,012 A 4/1994 Kamada
5,316,539 A * 5/1994 Leemhuis et al. ..... 493/459
5,533,821 A 7/1996 Awai et al.
5,566,906 A 10/1996 Kamada et al.
5,718,526 A * 2/1998 Yokota ..... 400/605
5,884,860 A * 3/1999 Ishikawa et al. ..... 242/422
6,112,048 A * 8/2000 Westhoff ..... 399/406

FOREIGN PATENT DOCUMENTS

| | | |
|---|---|---|
| EP | 0 587 368 A1 | 3/1994 |
| EP | 0 999 162 A2 | 5/2000 |
| GB | 2 171 082 A | 8/1986 |
| GB | 2 355 001 A | 4/2001 |
| JP | 56-43152 | 4/1981 |
| JP | 62-3729 | 1/1987 |
| JP | 7-277566 | 10/1995 |

OTHER PUBLICATIONS

Patent Abstracts of Japan, vol. 0092, No. 45, Oct. 2, 1985, JP 60–097163.
Patent Abstracts of Japan, vol. 0103, No. 15, Oct. 25, 1986, JP 61–124463.

* cited by examiner

*Primary Examiner*—Andrew H. Hirshfeld
*Assistant Examiner*—Leo T. Hinze
(74) *Attorney, Agent, or Firm*—Sughrue Mion, PLLC

(57) ABSTRACT

A roll paper curl correction device has a clamp roller for clamping and transporting roll paper, and a guide member comprising a guide face being positioned in the downstream proximity of the clamp roller and formed so that the roll paper is curved to an opposite side of a curl tendency of the roll paper for coming in contact with the non-print side of the paper roll. The guide face can be a curve face formed so as to curve to the opposite side of the curl tendency of the roll paper.

24 Claims, 21 Drawing Sheets

| CORRECTION ANGLE θ (° ) | ROLL PAPER CURVATURE RADIUS r (mm) | WARPAGE AMOUNT A (mm) |
|---|---|---|
| PAPER IS NOT PASSED THROUGH | ——— | 32 |
| 0 | ——— | 30 |
| 40 | 22 | 25 |
| 60 | 16.7 | 20 |
| 72 | 11.8 | 13 |
| 75 | 10.6 | 11 |
| 77 | 9.7 | 7 |
| 80 | 8.8 | 1 |

ROLL PAPER CURL CORRECTION DEVICE AND RECORD APPARATUS WITH THE ROLL PAPER CURL CORRECTION DEVICE

BACKGROUND OF THE INVENTION

1. Field of the Invention

This invention relates to a device for correcting roll paper curl and a record apparatus comprising that device.

2. Description of Related Arts

In a record apparatus typified by a FAX, a printer, etc., roll paper on which recording (print) can be executed over long length is used. In recent years, as a consumer-oriented printer for realizing photo image quality, a printer that can print at silver-salt photo level using roll paper has been developed.

On the other hand, the roll paper has a characteristic different from that of a usual single sheet of paper, namely, has nature of curl left still after being unrolled because the roll paper is rolled like a roll. Thus, a disadvantage may occur in handling the roll paper after print. That is, if the roll paper is curled, the possibility that a paper jam may occur in a print process is raised and in addition, print matter cut to a predetermined length as a single sheet of paper is rounded and it becomes difficult to flatten it neatly.

To remove such curl of roll paper, for example, Japanese Patent Publication JP-56-43152A (or JP-62-3729B) proposes a device wherein one of a pair of rollers is made up of a rotatable shaft member and a circumferential member disposed on the peripheral surface of the shaft member for rotation and the shaft member is provided in a part with a decurl member projecting from the surface of the circumferential member and having a concave face fitted into a part of the surface of the other roller.

JP-07-277566A proposes a decurling device comprising a decurl roller for coming in contact with the outer face of roll paper and inverting the roller paper to the outside for removing curl of the roll paper, decurl release device for moving the decurl roller at the decurl release stop time, an urging device for urging the decurl roller by a predetermined force at the decular release operation time, and a turn roller and a guide section for clamping and transporting the decurl roller and record paper at the decular release operation time.

However, in the related arts, when the curl of roll paper is removed, the curl is forcibly corrected with the roller surface in contact with the print side of the roll paper and thus there is a possibility that the print side may be damaged, may be made dirty, or may be wrinkled.

Generally, to reliably correct the curl of roll paper, it is necessary to lessen the curvature when the roll paper is curved; however, for example, if the roll paper is thick high-image-quality print paper having a coat layer, it is feared that the roll paper cannot appropriately or smoothly pass through a curve formation section for forming the roll paper with a curve condition because of the effect of the rigidity of the roll paper.

On the other hand, if the curl correction degree is stronger than the original roller paper curl, the roll paper is curved (overdecurled) in an opposite direction to the original curl.

If the roll paper is thus overdecurled, for example, the following problem occurs: In an ink jet printer capable of printing on roll paper, when roll paper is rolled with the print side upside, if the roll paper is overdecurled as described above, the roll paper tip gets snagged on a paper transport passage or comes in contact with an ink jet record head (head rubbing) and appropriate print operation cannot be performed or appropriate print quality cannot be provided.

SUMMARY OF THE INVENTION

It is therefore an object of the invention to remove curl of roll paper without coming in direct contact with the print side of the roll paper, and it is another object of the invention to allow roll paper to appropriately and smoothly pass through a curve formation section for forming a curve condition in roll paper.

It is still another object of the invention to prevent or decrease overdecurl in a roll paper curl correction device, thereby performing appropriate print operation or providing appropriate print quality.

To the ends, according to a first aspect of the invention, there is provided a roll paper curl correction device comprising a clamp roller for clamping and transporting roll paper, and a guide member comprising a guide face being positioned in the downstream proximity of the clamp roller and formed so that the roll paper is curved to an opposite side of a curl tendency of the roll paper for coming in contact with the non-print side of the paper roll.

According to the aspect of the invention, the roll paper receives the drive force in the advance direction by the clamp roller and advances, and collides with the guide face of the guide member. After this, the roll paper advances so as to curve to the opposite side of the curl tendency of the roll paper along the guide face, so that the curl and the forcible curve to the opposite side thereto cancel each other and the curl is corrected. When the roll paper advances along the guide face, only the non-print side of the roll paper comes in contact with the guide face and thus the print side does not come in contact with any members while the curl is being corrected. Therefore, the fear of damage to, making dirty, or wrinkling the print side of the roll paper is small.

A second aspect of the invention is characterized by the fact that in the roll paper curl correction device of the first aspect of the invention, the guide face is a curve face formed so as to curve to the opposite side of the curl tendency of the roll paper.

According to the aspect of the invention, the constant length of the roll paper in the advance direction of the non-print side of the roll paper is always in contact with the guide face, so that the roll paper is forcibly curved to the opposite side of the curl direction and the curl is corrected.

A third aspect of the invention is characterized by the fact that in the roll paper curl correction device of the first aspect of the invention, the guide face is a peripheral surface of a guide roller positioned at a position in a roll paper transport passage in the downstream proximity of the clamp roller and the guide roller is rotatable in a direction in which the roll paper is curved to the opposite side of the curl tendency of the roll paper.

According to the aspect of the invention, the roll paper given the drive force by the clamp roller collides with the peripheral surface of the guide roller. The advance direction of the roll paper is forcibly curved so that the roll paper is curved in the rotation direction of the guide roller, the opposite side of the curl tendency of the roll paper, and thus the curl is corrected.

A fourth aspect of the invention is characterized by the fact that in the roll paper curl correction device of the second aspect of the invention, the curvature radius of the curve face is 15 mm or less. More preferably, the curvature radius is set to 10 mm or less.

According to the aspect of the invention, the curvature radius is comparatively small and thus if roll paper has strong curl, the curl is well removed as the advance direction is rapidly changed.

A fifth aspect of the invention is characterized by the fact that in the roll paper curl correction device of the third aspect of the invention, the diameter, the position, and the rotation speed of the guide roller are determined so that the roll paper is curved in a state in which the curvature radius becomes 15 mm or less to the opposite side of the curl tendency of the roll paper.

According to the aspect of the invention, the roll paper is forcibly curved so that the curvature radius becomes comparatively small to the opposite side of the curl tendency of the roll paper. Thus, if the roll paper has strong curl, the curl is well removed as the advance direction is rapidly changed.

A sixth aspect of the invention is characterized by the fact that in the roll paper curl correction device of any of the first to fifth aspects of the invention, the clamp roller comprises a drive roller placed on the non-print side of the roll paper and a driven roller having a peripheral surface for coming in contact with the peripheral surface of the drive roller in a press contact state.

According to the aspect of the invention, the roll paper is sandwiched between the drive roller and the driven roller by a comparatively strong force, thereby contributing to correction to the curl of the roll paper. The roll paper is reliably delivered in the advance direction by the drive roller and the driven roller, whereby the drive force for causing the roller paper to advance while being curved along the guide face is produced.

A seventh aspect of the invention is characterized by the fact that in any of the first to sixth aspects of the invention, the angle between the roll paper paid out from the clamp roller and the roll paper passing through the guide face form substantially a right angle with a transport passage as a side view.

According to the aspect of the invention, the angle between the roll paper paid out from the clamp roller and the roll paper passing through the guide face form substantially a right angle with the transport passage as a side view. Thus, after the roll paper is paid out from the clamp roller, the advance direction of the roll paper is changed at a steep angle (substantially right angle) by the guide face, whereby a curve condition with a small curvature is formed in the roll paper, so that it is made possible to reliably correct the curl of the roll paper. Particularly, if the roll paper is thick coated paper providing photo image quality, the function can be still more exerted.

An eighth aspect of the invention is characterized by the fact that in any of the first to seventh aspects of the invention, the passage length between the clamp roller and the guide face is 8 mm or less.

According to the aspect of the invention, the passage length between the clamp roller and the guide face is 8 mm or less. Thus, the curve condition formed in the roll paper becomes still stronger, so that it is made possible to correct the curl of the roll paper still more reliably.

According to a ninth aspect of the invention, there is provided a roll paper curl correction device for correcting curl of roll paper unrolled from a paper roll rolled like a roll, the roll paper curl correction device comprising a clamp roller for clamping and transporting roll paper, and an auxiliary roller being placed at a position in the downstream proximity of the clamp roller and abutting the roll paper paid out from the clamp roller for forming a curve condition in the roll paper by changing the advance direction of the roll paper and downstream guiding the roll paper by rotating, characterized in that circumferential velocity of the outer periphery of the auxiliary roller, $V_B$, is set larger than circumferential velocity of the outer periphery of the clamp roller, $V_A$.

According to the aspect of the invention, it is made possible for the roll paper to appropriately and smoothly pass through the curve formation section for forming a curve condition in the roll paper. That is, the roll paper paid out from the clamp roller abuts the auxiliary roller and is changed in the advance direction (curved) and advances downstream. At this time, the roll paper abuts the auxiliary roller for downstream guiding the roll paper by rotating. Thus, if the roll paper is abutted against the auxiliary roller at a steep angle to lessen the curvature to curve the roll paper, the roll paper can advance smoothly downstream with no load.

If the roll paper strikes the auxiliary roller at a steep angle, when the roll paper tip abuts the auxiliary roller, it is feared that the roll paper tip portion may be curved in the reverse direction (opposite direction to the advance direction (downstream)), causing a paper jam to occur. In the aspect of the invention, however, the circumferential velocity of the outer periphery of the auxiliary roller, $V_B$, is set larger than the circumferential velocity of the outer periphery of the clamp roller, $V_A$. Therefore, the roll paper tip abuts the auxiliary roller rotating at paper delivery velocity higher than the paper delivery velocity of the clamp roller, so that the roll paper tip is appropriately guided downward and thus it is made possible to allow the roll paper to appropriately pass through.

In addition, if the side of the roll paper abutting the auxiliary roller is the non-print side of the roll paper, the print side does not come in contact with any members while the curl is being corrected. Therefore, the fear of damage to, making dirty, or wrinkling the print side of the roll paper is small.

A tenth aspect of the invention is characterized by the fact that in the ninth aspect of the invention, $V_B \geqq 2V_A$.

According to the aspect of the invention, the circumferential velocity of the outer periphery of the auxiliary roller, $V_B$, is set twice or more the circumferential velocity of the outer periphery of the clamp roller, $V_A$, so that it is made possible to provide the function of the device of the ninth aspect still more reliably.

An eleventh aspect of the invention is characterized by the fact that in the ninth or tenth aspect of the invention, the angle between the roll paper paid out from the clamp roller and the roll paper passing through the auxiliary roller form substantially a right angle with a transport passage as a side view.

According to the aspect of the invention, the angle between the roll paper paid out from the clamp roller and the roll paper passing through the auxiliary roller form substantially a right angle with the transport passage as a side view. Thus, after the roll paper is paid out from the clamp roller, the advance direction of the roll paper is changed at a steep angle (substantially right angle) by the auxiliary roller, whereby a curve condition with a small curvature is formed in the roll paper, so that it is made possible to reliably correct the curl of the roll paper. Particularly, if the roll paper is thick coated paper providing photo image quality, the function can be still more exerted.

A twelfth aspect of the invention is characterized by the fact that in any of the ninth to eleventh aspects of the invention, the outer periphery of the auxiliary roller is formed of an elastic material.

According to the aspect of the invention, the outer periphery of the auxiliary roller is formed of an elastic material, so that the roll paper tip is guided reliably downstream as the auxiliary roller is rotated. Therefore, it is made possible to effectively prevent a problem such that the roll paper tip abutting the outer periphery of the auxiliary roller proceeds in an opposite direction to the normal advance direction.

A thirteenth aspect of the invention is characterized by the fact that in any of the ninth to twelfth aspects of the invention, the auxiliary roller comes in contact with the non-print side of the roll paper.

According to the aspect of the invention, the auxiliary roller comes in contact with the non-print side of the roll paper, so that the fear of damage to, making dirty, or wrinkling the print side of the roll paper is small.

According to a fourteenth aspect of the invention, there is provided a record apparatus comprising a roll paper curl correction device of any of the first to thirteenth aspects of the invention.

According to the aspect of the invention, the roll paper is transported with the curl of the roll paper corrected, so that a paper jam while the roll paper is transported and rolling printed matter as a single sheet of paper when the roll paper is cut after print, etc., can be eliminated. In addition, it is made possible to provide a similar advantage to that of the curl correction device of any of the first to thirteenth aspects of the invention in the record apparatus.

According to a fifteenth aspect of the invention, there is provided a roll paper curl correction device for correcting curl of roll paper unrolled from a paper roll rolled like a roll, the roll paper curl correction device comprising a clamp roller for clamping and transporting the roll paper, and a curve formation section being placed in the downstream proximity of the clamp roller for curving the roll paper in an opposite direction to the curl, characterized in that the clamp roller comprises a drive roller which is rotated, and a driven roller having a peripheral surface for coming in contact with the peripheral surface of the drive roller in a press contact state, the driven roller being disposed so that the position pressed against the drive roller can be displaced.

According to the aspect of the invention, the curl correction degree is optimized, whereby the phenomenon in which roll paper warps in the opposite direction to the initial curl direction, which will hereinafter referred to as overdecurl, is decreased or prevented effectively, so that it is made possible to perform appropriate record operation and further provide appropriate record quality in a record apparatus, etc., for recording on a record material. That is, the roll paper curl correction device has the clamp roller for clamping and transporting the roll paper, and the curve formation section being placed in the downstream proximity of the clamp roller for curving the roll paper in the opposite direction to the curl, and curves the roll paper paid out from the clamp roller by the curve formation section for correcting the curl.

The clamp roller is made up of the drive roller which is rotated, and the driven roller having a peripheral surface for coming in contact with the peripheral surface of the drive roller in a press contact state, the driven roller being disposed so that the position pressed against the drive roller can be displaced. Therefore, as the driven roller is displaced, the angle at which the roll paper advances to the curve formation section can be changed as desired and accordingly the curvature for decurling can be changed as desired. Therefore, if the driven roller is displaced in response to the quality, the use environment, etc., of the roll paper, overdecurl can be decreased or prevented.

The roll paper curl correction device of the sixteenth aspect of the invention is characterized by the fact that in the fifteenth aspect of the invention, the curve formation section is implemented as an auxiliary roller being placed at a position abutting the roll paper paid out from the clamp roller for forming a curve condition in the roll paper by changing the advance direction of the roll paper and downstream guiding the roll paper by rotating.

According to the sixteenth aspect of the invention, it is made possible for the roll paper to smoothly pass through the curve formation section for forming a curve condition in the roll paper. That is, the roll paper paid out from the clamp roller abuts the auxiliary roller and is changed in the advance direction (curved) and advances downstream. At this time, the roll paper abuts the auxiliary roller for downstream guiding the roll paper by rotating. Thus, if the roll paper is abutted against the auxiliary roller at a steep angle to lessen the curvature to decurl the roll paper, the roll paper can advance smoothly downstream with no load, so that it can be allowed to smoothly pass through.

According to a seventeenth aspect of the invention, there is provided a roll paper curl correction device for correcting curl of roll-paper unrolled from a paper roll rolled like a roll by a curving device for curving the roll paper in an opposite direction to the curl, the roll paper curl correction device comprising a correction amount adjustment mechanism for adjusting the curl correction degree, characterized in that the correction amount adjustment mechanism corrects the curl of the tip portion of the roll paper unrolled from the paper roll more moderately than the curl of the portion following the tip portion of the roll paper.

To incorporate the roll paper curl correction device in a record apparatus for recording on a record material, as the problem involved in overdecurl, the overdecurled roll paper tip is caught in a position in the paper passage or rubs against the record head and therefore if the overdecurl of only the tip portion of the roll paper is decreased or removed, the later transport operation or record operation is not much adversely affected although the overdecurl of the portion following the tip portion of the roll paper is noticeable.

From such a viewpoint, in the aspect of the invention, the correction amount adjustment mechanism for adjusting the curl correction degree corrects the curl of the tip portion of the roll paper more moderately than the curl of the portion following the tip portion of the roll paper. Therefore, for example, if the curvature of decurl is set small to reliably correct the curl, the curl of the tip portion of the roll paper is corrected moderately, so that the overdecurl of the tip portion of the roll paper is decreased or prevented and thus the record apparatus can accomplish the appropriate record operation or can provide the appropriate record result.

The roll paper curl correction device of the eighteenth aspect of the invention is characterized by the fact that in the seventeenth aspect of the invention, the curving device comprises a clamp roller for clamping and transporting the roll paper, and a curve formation section being placed in the downstream proximity of the clamp roller for curving the roll paper in the opposite direction to the curl.

According to the eighteenth aspect of the invention, the curving device comprises the clamp roller for clamping and transporting the roll paper, and the curve formation section being placed in the downstream proximity of the clamp roller for curving the roll paper in the opposite direction to the curl. Thus, if load of the roll paper is generated by the curve formation section, the transport roller for transporting the roll paper is disposed in the proximity of the curve formation section, so that the roll paper can be reliably transported without producing distortion, etc., in the roll paper.

The roll paper curl correction device of the nineteenth aspect of the invention is characterized by the fact that in the eighteenth aspect of the invention, the curve formation section is implemented as an auxiliary roller being placed at a position abutting the roll paper paid out from the clamp roller for forming a curve condition in the roll paper by changing the advance direction of the roll paper and downstream guiding the roll paper by rotating.

According to the nineteenth aspect of the invention, it is made possible for the roll paper to smoothly pass through the curve formation section for forming a curve condition in the roll paper. That is, the roll paper paid out from the clamp roller abuts the auxiliary roller and is changed (namely curved) in the advance direction and advances downstream. At this time, the roll paper abuts the auxiliary roller for downstream guiding the roll paper by rotating. Thus, if the roll paper is abutted against the auxiliary roller at a steep angle to lessen the curvature to decurl the roll paper, the roll paper can advance smoothly downstream with no load, so that it can be allowed to smoothly pass through.

The roll paper curl correction device of the twentieth aspect of the invention is characterized by the fact that in the eighteenth or nineteenth aspect of the invention, the clamp roller comprises a drive roller which is rotated, and a driven roller having a peripheral surface for coming in contact with the peripheral surface of the drive roller in a press contact state, the driven roller being disposed so that the position pressed against the drive roller can be displaced.

According to the twentieth aspect of the invention, the clamp roller comprises the drive roller which is rotated, and the driven roller having a peripheral surface for coming in contact with the peripheral surface of the drive roller in a press contact state, the driven roller being disposed so that the position pressed against the drive roller can be displaced. Thus, as the driven roller is displaced, the roll paper paying-out direction (advance direction) can be changed, so that the curvature of the curve condition of the roll paper can be changed and thus it is made possible to adjust the curl correction degree easily and as desired.

The roll paper curl correction device of the twenty-first aspect of the invention is characterized by the fact that in any of the seventeenth to twentieth aspects of the invention, the correction amount adjustment mechanism corrects the curl of the tip portion of the roll paper more moderately than the curl of the portion following the tip portion of the roll paper by setting velocity $V_{A1}$ at which the tip portion of the roll paper passes through the curving device larger than velocity $V_{A2}$ at which the portion following the tip portion of the roll paper passes through the curving device.

According to the twenty-first aspect of the invention, it is made possible to provide the correction amount adjustment mechanism for adjusting the curl correction degree at low cost and easily. That is, considering that the higher the velocity at which the roll paper passes through the curving device for correcting the curl of the roll paper, the more moderate the curl correction degree, in the invention, the velocity $V_{A1}$ at which the tip portion of the roll paper passes through the curving device is set larger than the velocity $V_{A2}$ at which the portion following the tip portion of the roll paper P passes through the curving device. Therefore, the component for adjusting the curl correction degree becomes unnecessary and thus it is made possible to provide the correction amount adjustment mechanism at low cost and easily.

The roll paper curl correction device of the twenty-second aspect of the invention is characterized by the fact that in any of the seventeenth to twentieth aspects of the invention, the correction amount adjustment mechanism corrects the curl of the tip portion of the roll paper more moderately than the curl of the portion following the tip portion of the roll paper by setting curvature $R_1$ when the tip portion of the roll paper passes through the curving device larger than curvature $R_2$ when the portion following the tip portion of the roll paper P passes through the curving device.

According to the twenty-second aspect of the invention, it is made possible to decrease or prevent the overdecurl of the tip portion of the roll paper and allow roll paper reliably to pass through the curving device regardless of the type of roll paper. That is, the correction amount adjustment mechanism adjusts the curl correction degree by setting curvature $R_1$ when the tip portion of the roll paper passes through the curving device larger than curvature $R_2$ when the portion following the tip portion of the roll paper P passes through the curving device. Thus, if the roll paper is thick, it can be allowed to pass through the curving device reliably without any strain at a moderate curvature, so that it is made possible to decrease or prevent the overdecurl of the tip portion of the roll paper.

According to a twenty-third aspect of the invention, there is provided a record apparatus being capable of recording on roll paper and comprising a roll paper curl correction device of any of the fifteenth to twenty-second aspects of the invention.

According to the twenty-third aspect of the invention, it is made possible to provide a similar advantage to that of the curl correction device of any of the fifteenth to twenty-second aspects of the invention in the record apparatus capable of recording on roll paper.

According to the invention, the roll paper receives the drive force in the advance direction by the clamp roller and advances, and collides with the guide face of the guide member. After this, the roll paper advances so as to curve to the opposite side of the curl tendency of the roll paper along the guide face, so that the curl and the forcible curve to the opposite side thereto cancel each other and the curl is corrected. When the roll paper advances along the guide face, only the non-print side of the roll paper comes in contact with the guide face and thus the print side does not come in contact with any members while the curl is being corrected. Therefore, the fear of damage to, making dirty, or wrinkling the print side of the roll paper is small.

According to the invention, in the roll paper curl correction device comprising the clamp roller for clamping and transporting the roll paper, and the curve formation section being placed in the downstream proximity of the clamp roller for curving the roll paper in the opposite direction to the curl, the curl correction device for correcting curl of roll paper unrolled from a paper roll rolled like a roll, the clamp roller comprises the drive roller which is rotated, and the driven roller having a peripheral surface for coming in contact with the peripheral surface of the drive roller in a press contact state, the driven roller being disposed so that the position pressed against the drive roller can be displaced. Therefore, as the driven roller is displaced, the angle at which the roll paper advances to the curve formation section can be changed as desired and accordingly the curvature for decurling can be changed as desired. Therefore, if the driven roller is displaced in response to the quality, the use environment, etc., of the roll paper, overdecurl can be decreased or prevented.

BRIEF DESCRIPTION OF THE DRAWINGS

The above and other objects, features and advantages of the invention will become more apparent from the following description of the preferred exemplary embodiments of the invention taken in conjunction with accompanying drawings, in which.

DETAILED DESCRIPTION OF THE PREFERRED EMBODIMENTS

<<First Embodiment>>

Figure 1:
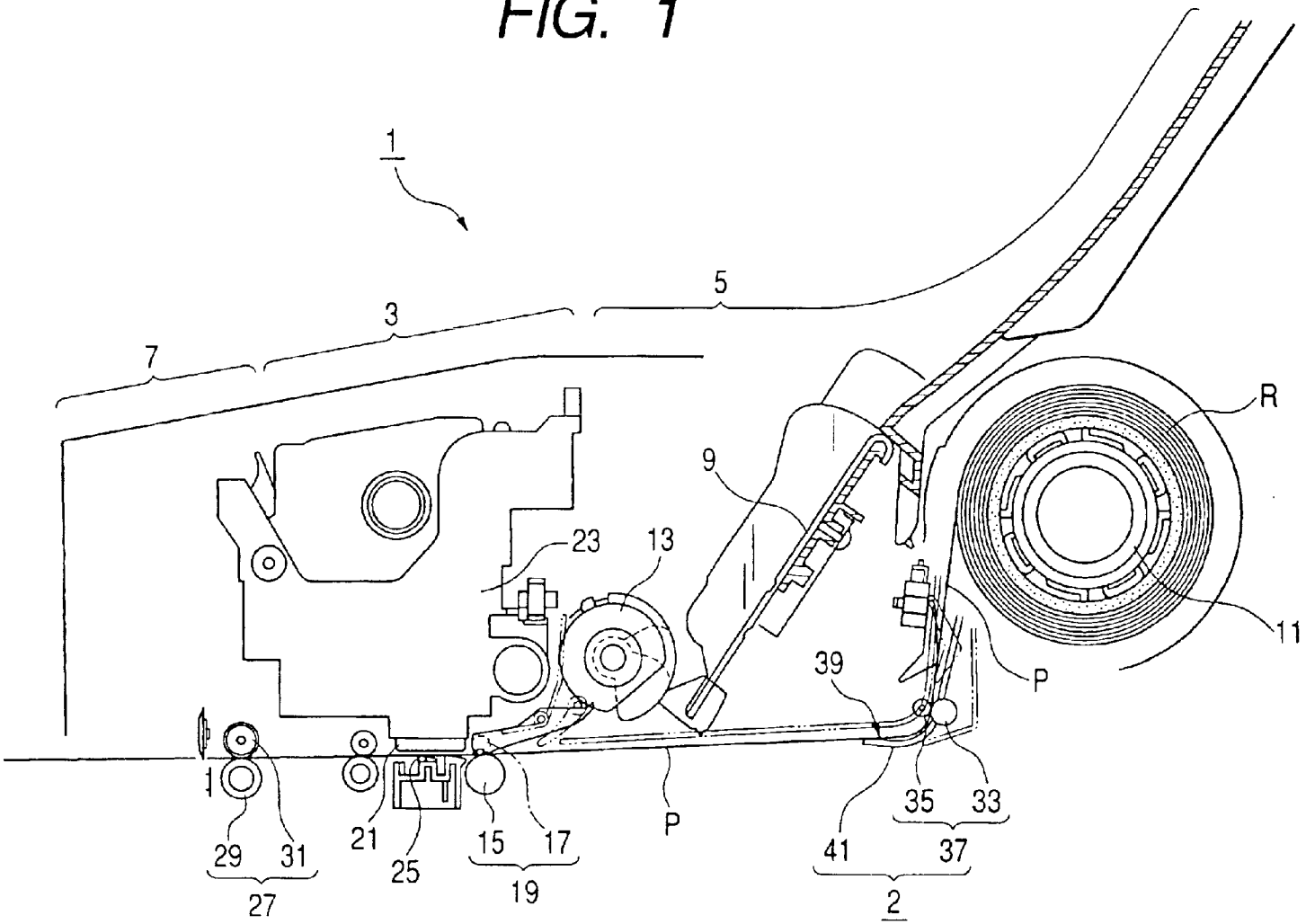
FIG. 1 is a schematic side view of an ink jet printer incorporating a roll paper curl correction device according to a first embodiment of the invention.
Figure 2:
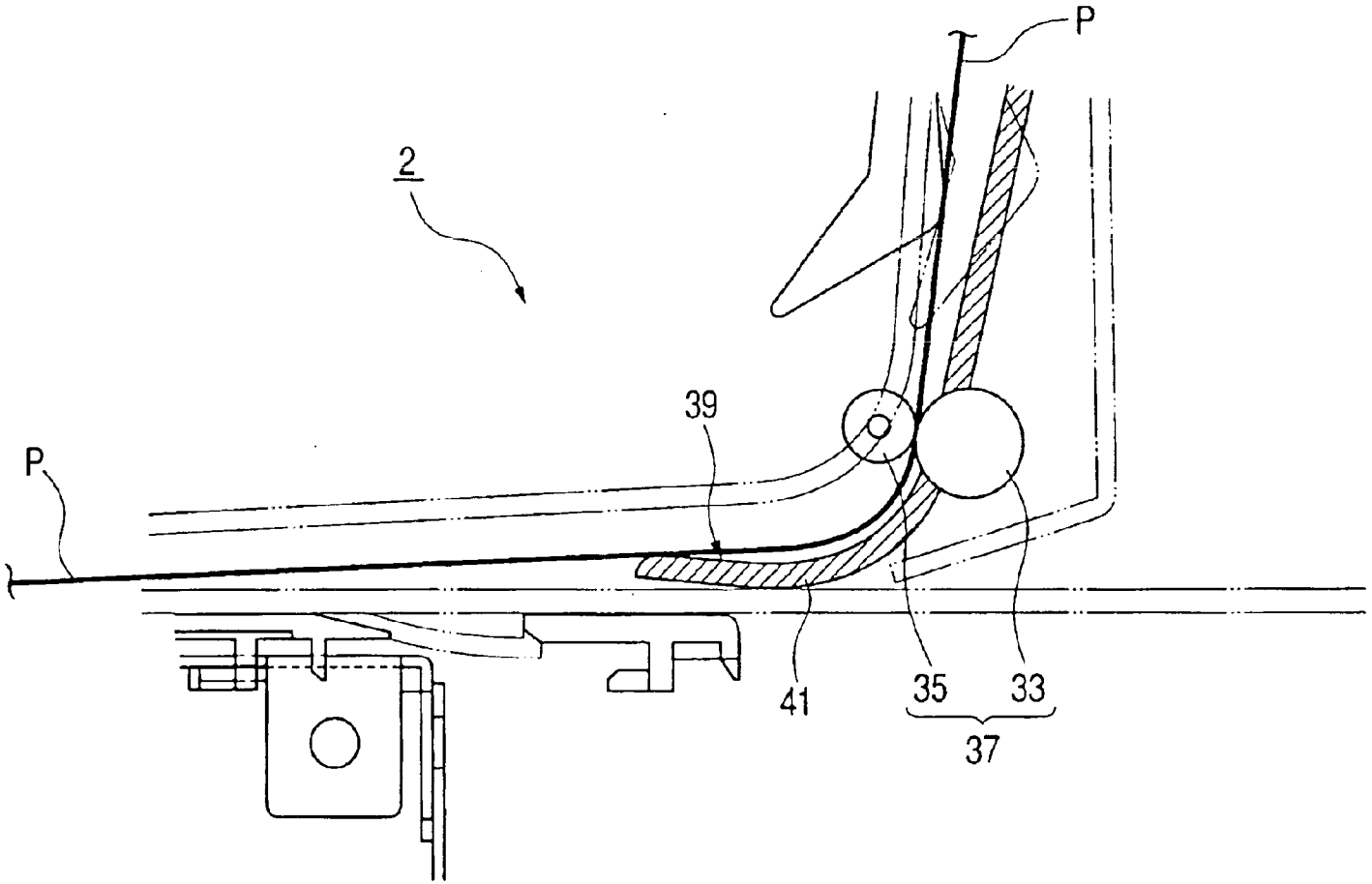
FIG. 2 is a sectional side view to show the peripheral structure of a guide member comprising a guide face.

A first embodiment of the invention will be discussed with reference to the accompanying drawings. FIG. 1 is a schematic sectional side view of an ink jet printer (simply, printer) 1 used for both single sheets of paper and roll paper incorporating a roll paper curl correction device according to the first embodiment of the invention.

The printer 1 comprises a printer main unit 3, a paper feeder 5 placed behind the printer main unit 3, and a paper ejection section 7 formed ahead the printer main unit 3.

The paper feeder 5 is provided with a hopper (paper feed tray) 9 in which a plurality of single sheets of paper can be stacked on each other, and a paper feed roller 13 for delivering single sheets of paper one at a time is placed just downstream from the hopper 9. On the other hand, a roll paper supply unit 11 for attaching a roll R of roll paper P is placed behind the hopper 9, and a passage where the roll paper P paid out from the roll R is passed through the hopper 9 and the lower side of a paper feed roller 13 and is fed into a paper delivery roller 19 is formed.

The paper delivery roller 19 is made up of a lower paper delivery drive roller 15 and an upper paper delivery driven roller 17. While paper (single sheet of paper or roll paper) is sandwiched between the rollers and receives precise paper delivery operation as the paper delivery drive roller 15 is rolled, it is transported to a print head 21 positioned downstream from the paper delivery roller 19. The print head 21 is supported on a carriage 23 that can be reciprocated in an orthogonal direction (main scanning direction: Front and back direction of the plane of FIG. 1) to the paper feed direction (subscanning direction: From side to side of FIG. 1).

A platen 25 is placed at a position opposed to the print head 21. To print on paper (single sheet of paper or roll paper) by the print head 21, the platen 25 supports the paper from the lower side and defines the gap between the print head 25 and the paper (paper gap). The distance between the print head 21 and the platen 25 can be adjusted appropriately depending on the thickness of paper, so that while the paper passes through smoothly on the platen 25, high-quality print can be accomplished. The paper printed by the print head 21 is ejected downstream in order by a second paper ejection roller 27 made up of a second paper ejection drive roller 29 and a second paper ejection serrated roller 31 placed in the paper ejection section 7.

A roll paper curl correction device 2 of the invention is placed at a position in the roll paper feed passage between the roll R of the roll paper R and the paper delivery roller 19 in the printer 1. A clamp roller 37 made up of a drive roller 33 positioned on the non-print side of the roll paper P and a driven roller 35 having a peripheral surface for coming in contact with the peripheral surface of the drive roller 33 in a press contact state is placed below a point where the roll paper P is paid out from the roll R. As the roll paper P passes through between the drive roller 33 and the driven roller 35, a drive force is given almost in a just down direction in the embodiment. As the roll paper P is strongly clamped in the clamp roller 37, curl of the roll paper can be corrected to some extent.

A guide member 41 comprising a guide face 39 for coming in contact with the non-print side of the paper roll P is placed just below the clamp roller 37. The guide face 39 of the guide member 41 is formed so as to curve to an opposite side of the curl tendency of the roll paper P, namely, the tendency of the print side to roll like a convex shape.

Figures 3, 4:
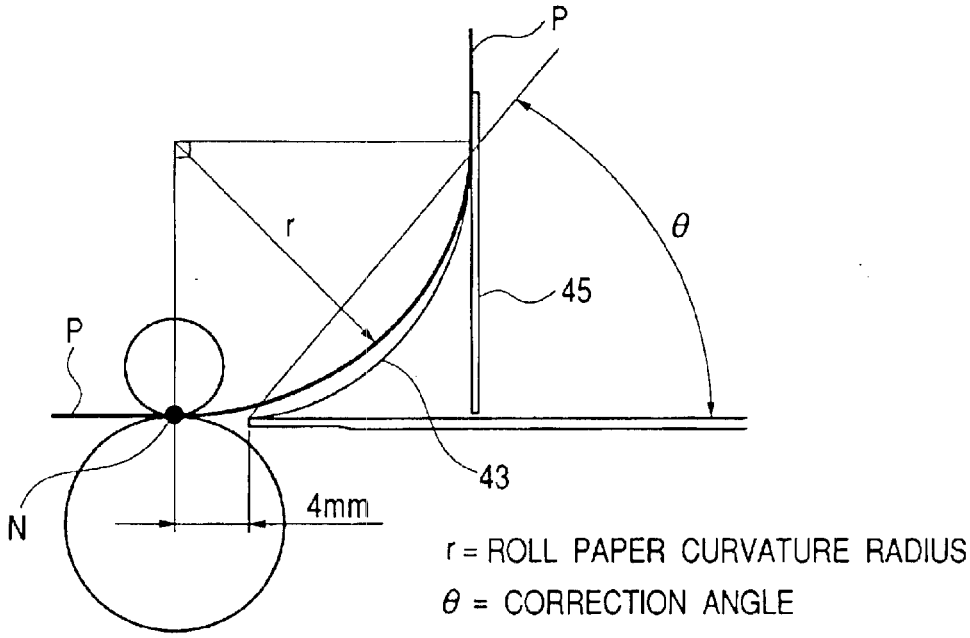
FIG. 3 is a schematic drawing to show an experiment to check that a curl correction is effectively made when roll paper is curved to the opposite side of the curl at what degree of curvature radius.
FIG. 4 is a table listing the relationship among correction angle θ, roll paper curvature radius r, and warpage amount A.

FIG. 3 is a schematic drawing to show an experiment to check that a curl correction is effectively made when the roll paper P is curved to the opposite side of the curl at what degree of curvature radius when the roll paper P passes through the guide face 39 (curve face) of the guide member 41. In FIG. 3, the tip of a guide plate 43 corresponding to the guide member is positioned at a point at a distance of 4 mm from a nip point N between two rollers and a correction plate 45 is put on an opposite end of the guide plate 43 and is moved from side to side, whereby the curve degree of the guide plate 43 can be changed.

Figure 5:
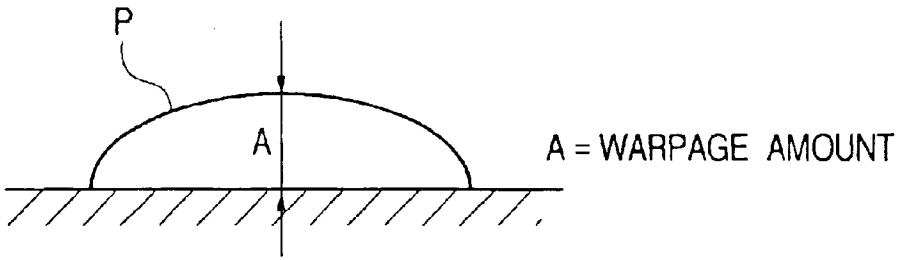
FIG. 5 is a schematic drawing to show a measurement method of the warpage amount A in the experiment in FIG. 3.

The curve degree of the roll paper P when the roll paper P moves along the guide plate 43 is indicated by curvature radius r, and the correction angle between the horizontal line at the tip of the guide plate 43 and the line connecting the tip and rear end of the guide plate 43 is indicated by θ. The warpage amount of the maximum float-up amount of the roll paper piece provided by delivering the roll paper P 130 mm along the guide plate 43 and cutting the portion 126 mm from the upper end of the roll paper P when the roll paper piece is placed on the horizontal surface in a natural condition as shown in FIG. 5 is indicated by A. The reason why the roll paper P is cut 126 mm is that this size is the photo service size under the present conditions.

Figure 6:
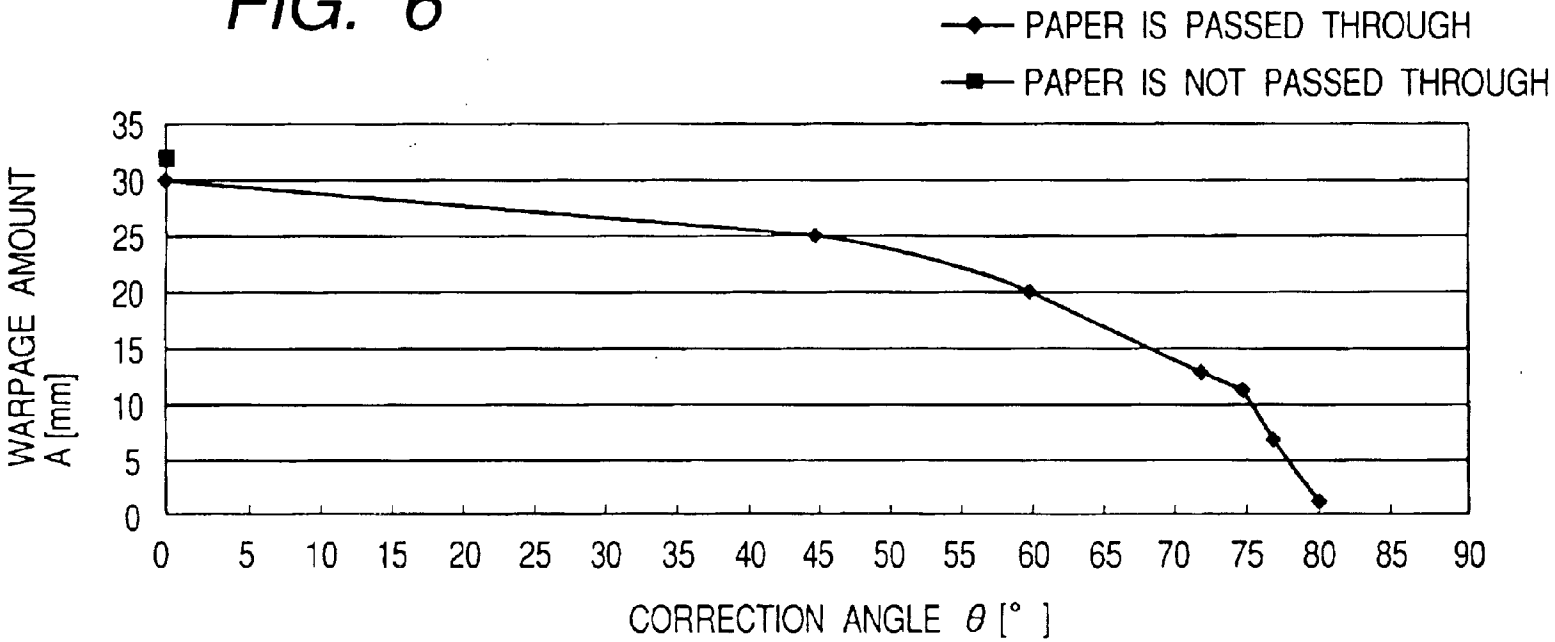
FIG. 6 is a graph to show the relationship between the correction angle θ and the warpage amount A.

FIG. 4 is a table listing the relationship among the correction angle θ, the roll paper curvature radius r, and the warpage amount A, and FIG. 6 is a graph of the relationship between the correction angle θ and the warpage amount A. As seen in FIG. 6, the warpage amount A is decreased rapidly at the correction angle 75 degrees or more and as shown in FIG. 4, the roll paper P curvature radius r at this time is about 10 mm. Therefore, it has been shown that the curl can be effectively corrected by curving the roll paper P to the opposite side of the curl so that the curvature radius becomes 10 mm or less. Thus, preferably the guide face 39 (curve face) of the guide member 41 is shaped so as to enable the roll paper P to be curved at the curvature radius 10 mm or less. However, the guide face 39 may be shaped so that the roll paper P curvature radius r becomes 10 mm or more depending on the type of roll paper, concurrent use of another correction device, or the curl correction purpose. It is shown that usually, if the roll paper P can be curved at curvature radius about 15 mm, curl can be almost corrected.

<<Second Embodiment>>

Figure 7:
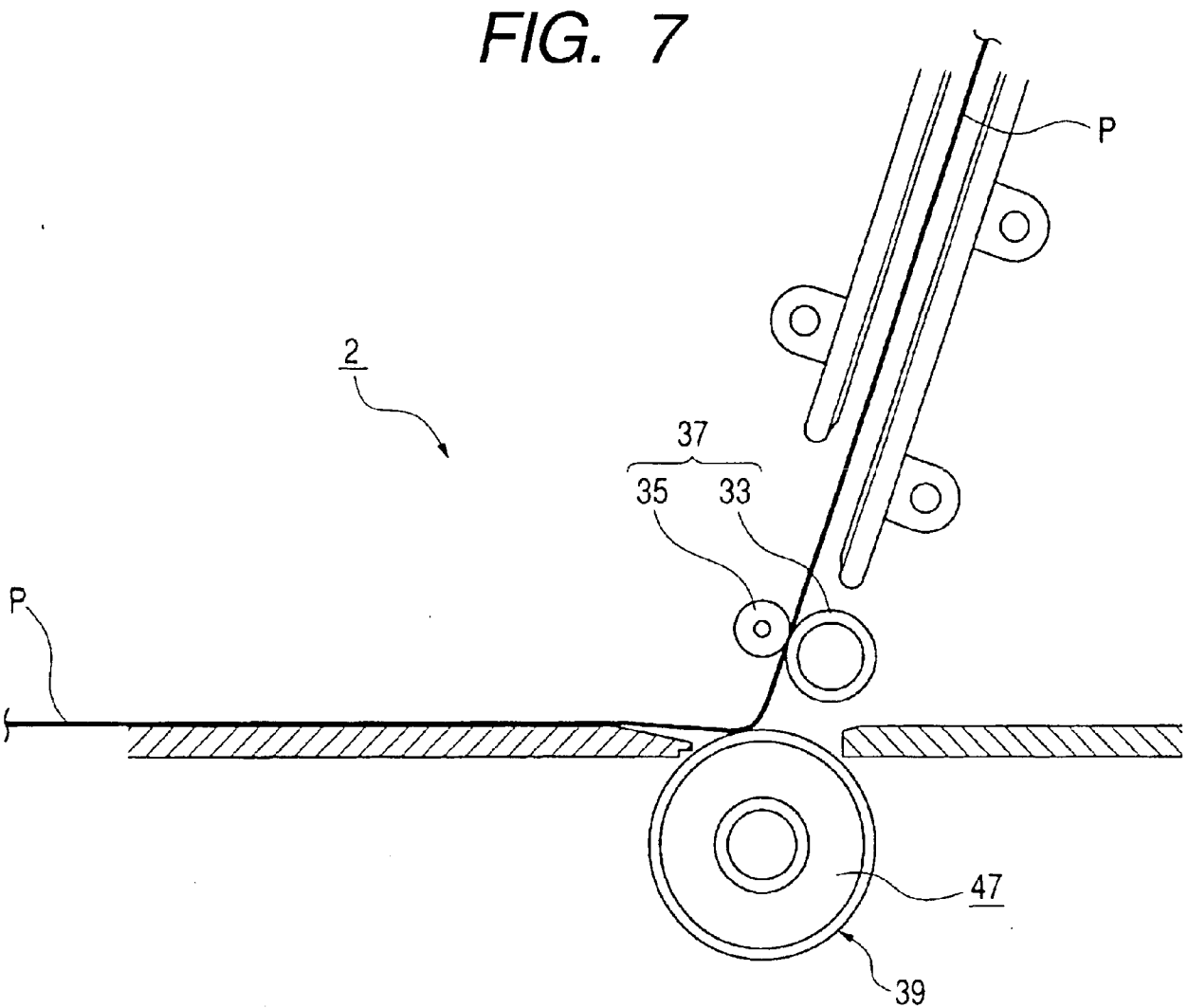
FIG. 7 is a sectional side view to show the peripheral structure of a guide member with the peripheral surface of a guide roller as a guide face in a second embodiment of the invention.

FIG. 7 shows a second embodiment of a roll paper curl correction device of the invention that can be applied in place of the roll paper curl correction device shown in FIG. 1. In FIG. 7, numeral 47 denotes an auxiliary roller (guide roller) positioned at a position in a roll paper transport passage in the downstream proximity of a clamp roller 37. The auxiliary roller 47 is formed on a peripheral surface with a guide face 39 for coming in contact with the non-print side of roll paper. The auxiliary roller 47 is rotated in a direction in which roll paper P is curved to an opposite side of the curl tendency of the roll paper, namely, counterclockwise in the embodiment.

In the described roll paper curl correction device, the non-print side of the roll paper R pushed out from the clamp roller 37 toward the guide face 39 of the peripheral surface of the auxiliary roller 47 comes in contact with the peripheral surface of the auxiliary roller 47, whereby it proceeds changing the direction so as to curve to the opposite side of the curl tendency of the roll paper and at this time, the roll paper curl is corrected.

Preferably, the diameter, the position, and the rotation speed of the auxiliary roller 47 are set so that the curvature radius when the roll paper P comes in contact with the peripheral surface (guide face 39) of the auxiliary roller 47, is curved, and is changed in direction becomes 15 mm or less, preferably 10 mm or less as in the first embodiment. Of course, in the second embodiment, the diameter, the position, and the rotation speed of the auxiliary roller 47 can also be set so that the roll paper P curvature radius r becomes 10 mm or more depending on the type of roll paper, concurrent use of another correction device, or the curl correction purpose.

In the above-described embodiment, the roll paper curl correction device is placed at a position in the roll paper feed passage between the roll R and the paper delivery roller 19, but a curl correction device of a similar structure may be placed downstream from the second paper ejection roller 27. The device can also be placed both between the roll R and the paper delivery roller 19 and downstream from the second paper ejection roller 27 so as to correct curl more reliably.

<<Third Embodiment>>

Next, a third embodiment of the invention will be discussed with reference to FIGS. 8 to 23C in the order of:

1. Configuration of ink jet printer
2. Configuration and function of roll paper curl correction device
3. Configuration and function of power transmission unit <1. Configuration of Ink Jet Printer>

Figure 8:
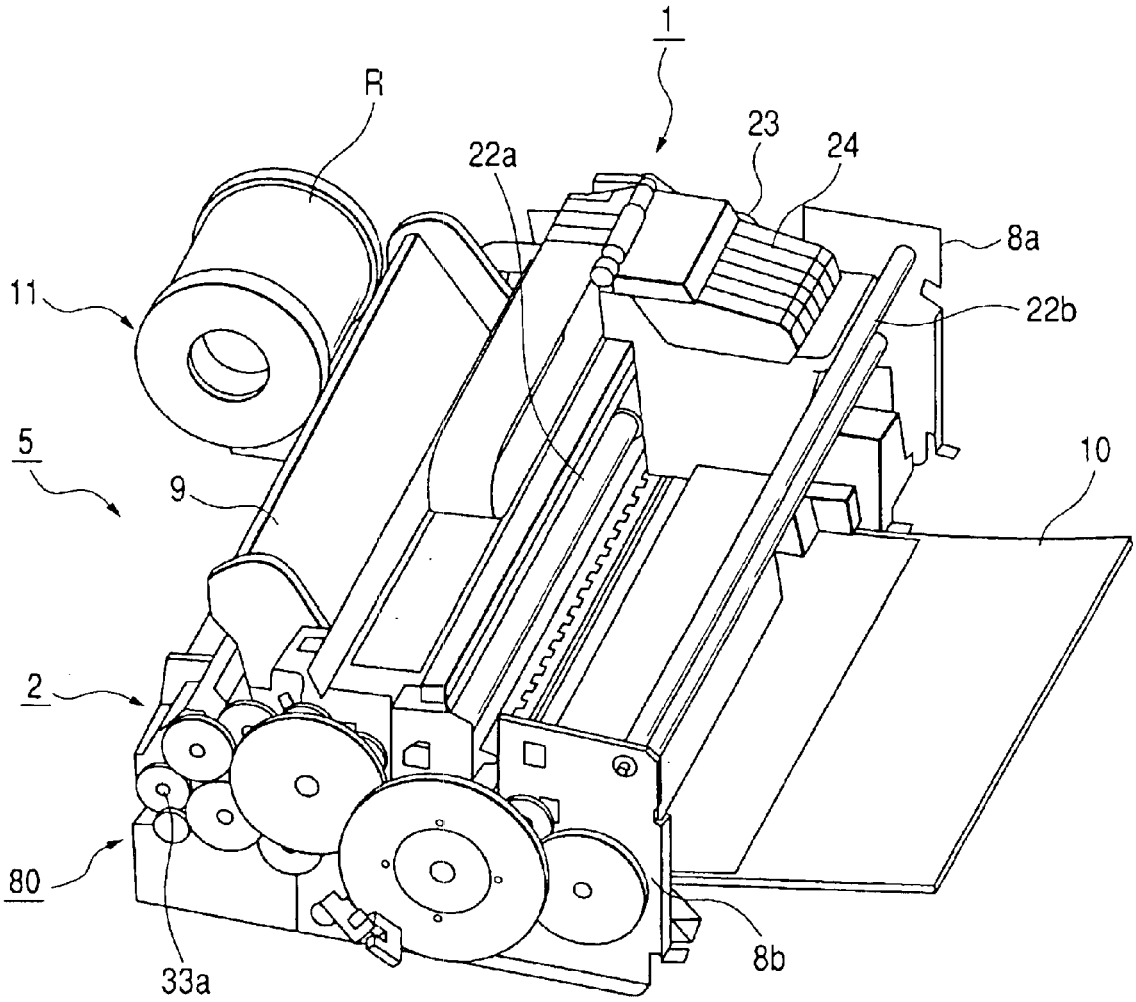
FIG. 8 is an external perspective view of an ink jet printer according to a third embodiment of the invention.

The configuration of an ink jet printer (simply, printer) 1 according to a third embodiment of the invention will be discussed in general with reference to FIGS. 8 to 10. FIG. 8 is an external perspective view of the printer 1 (with external cover removed), FIG. 9 is a schematic sectional side view of the printer 1, and FIG. 10 is a block diagram of a control system of the printer 1.

Figure 9:
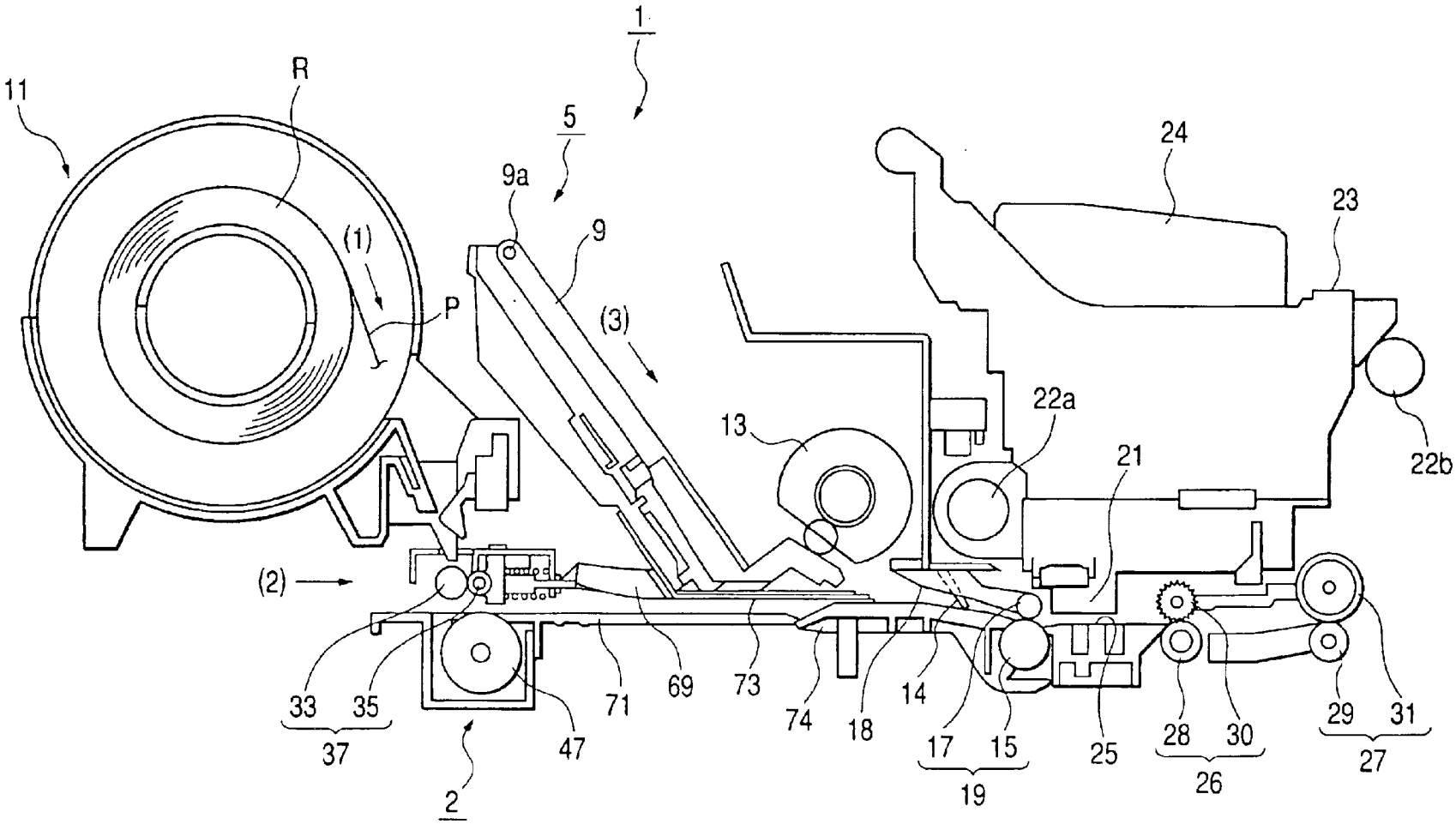
FIG. 9 is a schematic sectional side view of the ink jet printer according to the third embodiment of the invention.
Figure 10:
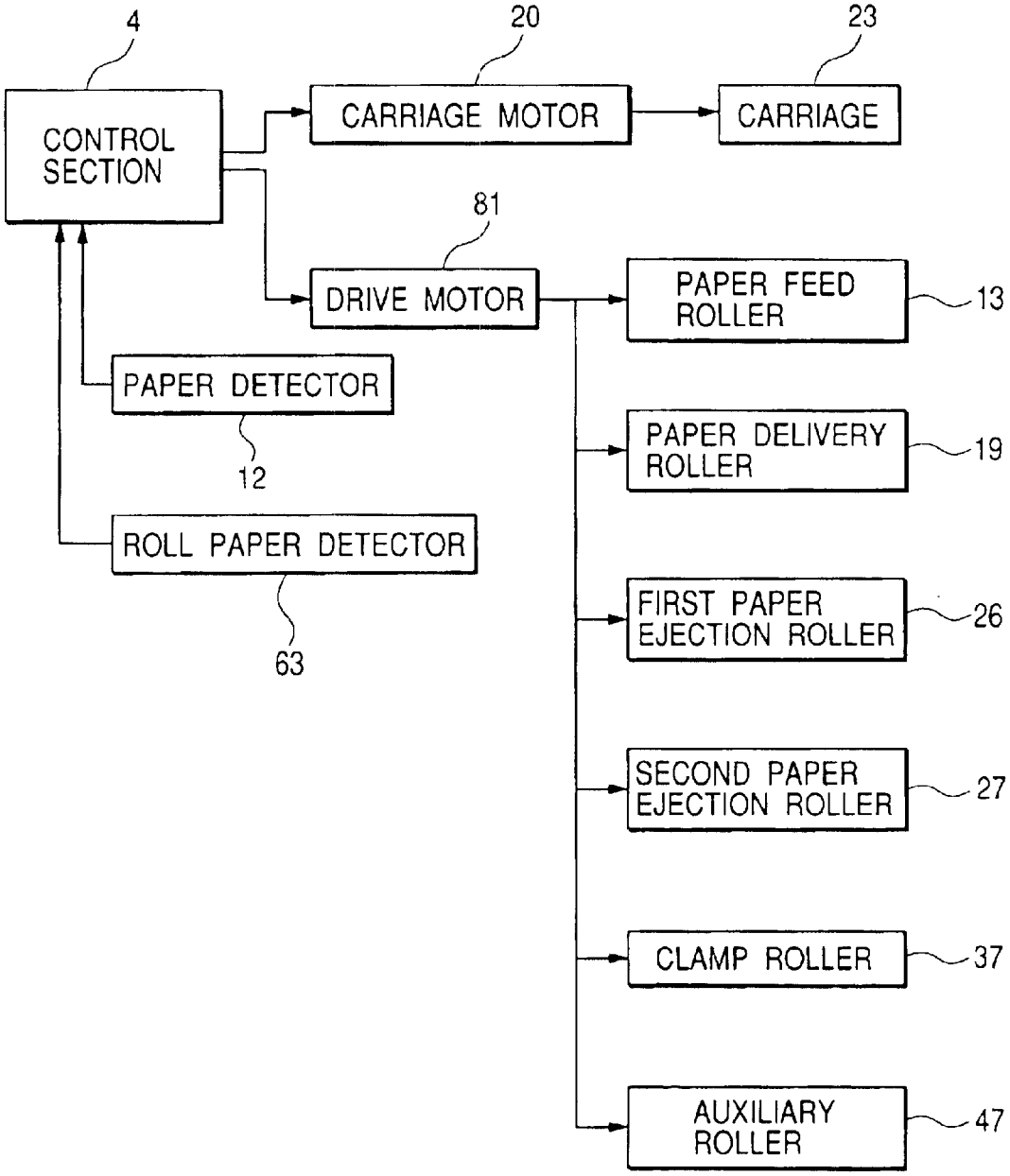
FIG. 10 is a block diagram of a control system of the ink jet printer according to the third embodiment of the invention.

In FIGS. 8 and 9, the printer 1 comprises a paper feeder 5 on the rear of the printer (the left of FIGS. 8 and 9). The paper feeder 5 feeds print paper as a record material (single sheet of paper, roll paper, paper board, etc., which will be hereinafter collectively called paper) downstream of a paper advance passage (the right of FIGS. 8 and 9).

More particularly, the paper feeder 5 comprises three paper feed passages of a first paper feed passage for paying out and feeding roll paper in a direction indicated by arrow (1) (slanting downward direction) as shown in FIG. 9 from a roll paper supply unit 11 for journaling a paper roll R for free rotation as shown in FIG. 8, a second paper feed passage for manually feeding a thick paper board, etc., that cannot pass through a curved paper feed passage in a direction indicated by arrow (2) (substantially horizontal direction) from the rear of the paper feeder 5, and a third paper feed passage for automatically feeding a single sheet of paper (ordinary paper, photo paper, OHP sheet, etc.,) that can pass through a curved paper feed passage in a direction indicated by arrow (3) (slanting downward direction) from a hopper 9 where a plurality of sheets of paper can be set in a tilt attitude. All the paper feed passages are directed to a paper delivery roller 19 (described later) placed downstream.

The first paper feed passage for feeding roll paper is a paper feed passage directed from the roll paper supply unit 11 to a roll paper curl correction device (simply, curl correction device) 2 (described later) placed slantingly forward below the roll paper supply unit 11, passing through the curl correction device 2 and then changed in direction substantially horizontally, passing through a paper passage formed by an upper rear paper guide 69, a lower rear paper guide 71, an upper front paper guide 73, and a lower front paper guide 74, and arriving at the paper delivery roller 19. The second paper feed passage for feeding a paper board, etc., is a paper feed passage entering the curl correction device 2 substantially horizontally from the rear of the paper feeder 2, crossing the curl correction device 2 and then passing through paper passage formed by the upper rear paper guide 69, etc., as described above and arriving at the paper delivery roller 19. Therefore, the first paper feed passage and the second paper feed passage cross each other (merge) in the curl correction device 2 and when roll paper P is in the first paper feed passage, the second paper feed passage cannot be used.

The hopper 9 forming the third paper feed passage is placed swingably (clockwise and counterclockwise in FIG. 9) with a swing support point 9*a* provided in an upper part as the center and is swung by a drive mechanism (not shown), whereby a lower part is pressed against and brought away from a paper feed roller 13. As it is pressed, a single sheet of paper stacked on the hopper 9 is fed into the paper delivery roller 19 with rotation of the paper feed roller 13. The paper feed roller 13 is rotated by a drive motor 81 (described later).

The paper delivery roller 19 is made up of a paper delivery drive roller 15 rotated by the drive motor 81 (described later) and a paper delivery driven roller 17 pressed against the paper delivery drive roller 15 and driven. The paper delivery driven roller 17 is journaled by a paper delivery driven roller holder 18 and a paper detection lever 14 implementing a paper detector 12 (see FIG. 10) for detecting the passage of paper is provided so as to project from the top to bottom of the paper delivery driven roller holder 18. The paper detection lever 14 is placed swingably clockwise and counterclockwise in FIG. 9 and swings in an upward push-up direction with the passage of the paper tip passing through the lower part of the paper delivery driven roller holder 18 and swings in a downward direction with the passage of the paper rear end, whereby the passage of the paper tip and the paper size can be detected.

A record head 21 and a platen 25 opposed to the record head 21 are placed downstream from the paper delivery roller 19. The record head 21 is placed below a carriage 23 and as ink is supplied to the record head 21 from an ink cartridge 24 mounted on the carriage 23, the record head 21 ejects ink droplets to paper pressed against the platen 25. The carriage 23 receives the drive force of a carriage motor 20 (see FIG. 10) and is reciprocated in a main scanning direction (front and back direction of the plane of FIG. 9) while it is guided by a main carriage guide shaft 22*a* and a sub carriage guide shaft 22*b* placed on a right side frame 8*a* placed upright on the right of the printer and a left side frame 8*b* placed upright on the left of the printer (see FIG. 8), making up the base of the printer 1.

Next, a first paper ejection roller 26 is placed downstream from the record head 21 and further a second paper ejection roller 27 is placed downstream from the first paper ejection roller 26. The first paper ejection roller 26 and the second paper ejection roller 27 are made up of a first paper ejection drive roller 28 and a second paper ejection drive roller 29 rotated by the drive motor 81 (described later) and a first paper ejection serrated roller 30 and a second paper ejection serrated roller 31 for coming in point contact with the rollers and being driven. The two pairs of rollers clamp paper and the drive rollers are rotated, whereby the paper is ejected to a paper ejection tray 10 (see FIG. 8).

The paper feed roller 13, the paper delivery roller 19 (paper delivery drive roller 15), the first paper ejection roller 26 (first paper ejection drive roller 28), and the second paper ejection roller 27 (second paper ejection drive roller 29) described above are rotated by one drive motor 81 as shown in FIG. 10 in the printer 1 according to the embodiment. In FIG. 10, a control section 4 comprises a hardware configuration of a CPU, memory, a motor driver, etc., (not shown) and controls driving the carriage motor 20 and the drive motor 81. Detection signals from a detection device, namely, the paper detector 12 and a roll paper detector 63 (described later) are input to the control section 4. The drive motor 81 rotates a clamp roller 37 and an auxiliary roller 47 (described later) in addition to the paper feed roller 13, etc., described above. A power transmission unit for transmitting power from the drive motor 81 to the clamp roller 37 and the auxiliary roller 47 will be discussed later in detail.

<2. Configuration and Function of Roll Paper Curl Correction Device>

Figure 11:
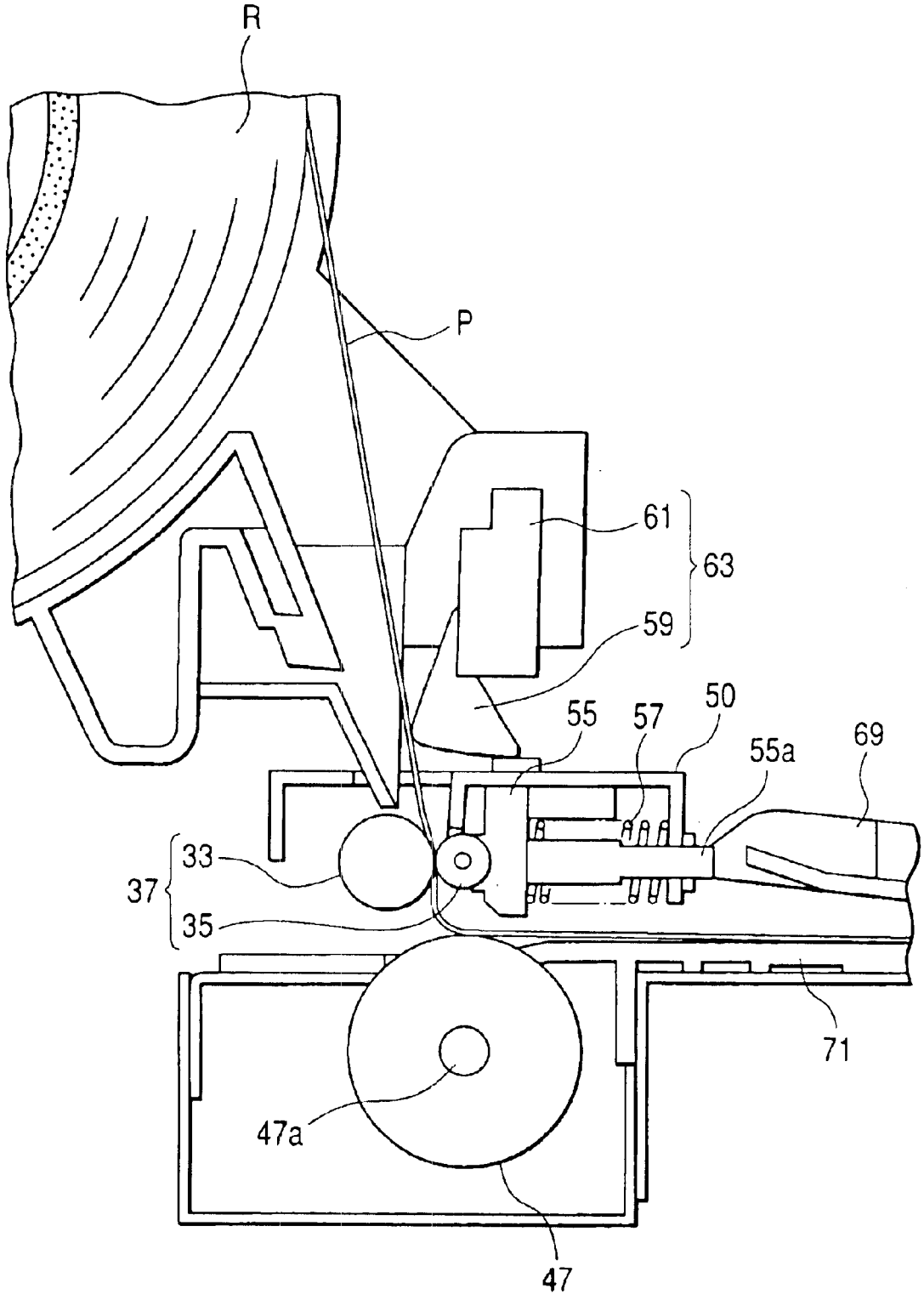
FIG. 11 is a sectional side view of a curl correction device according to the third embodiment of the invention.
Figure 12:
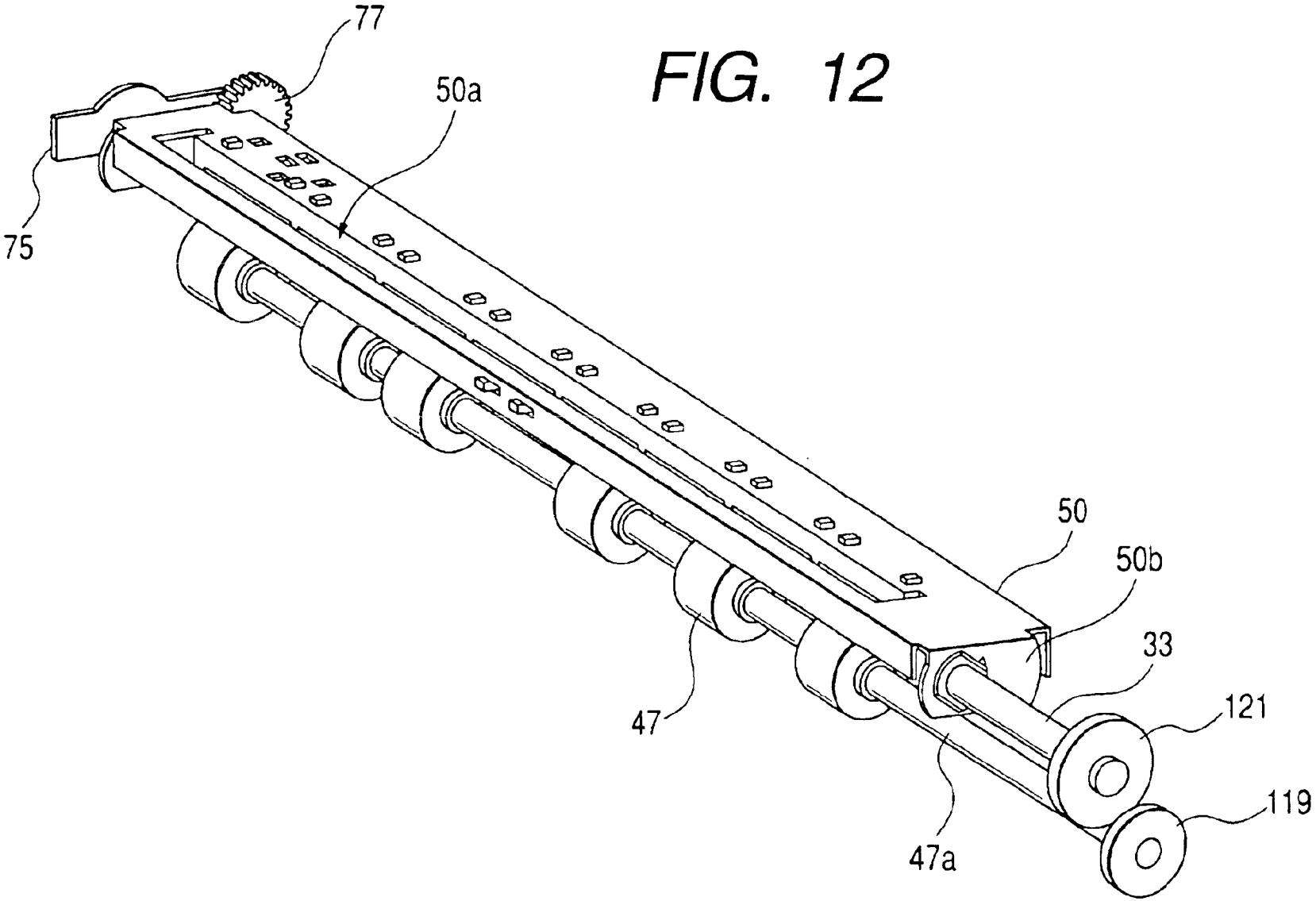
FIG. 12 is an external perspective view of a swing frame.
Figure 13:
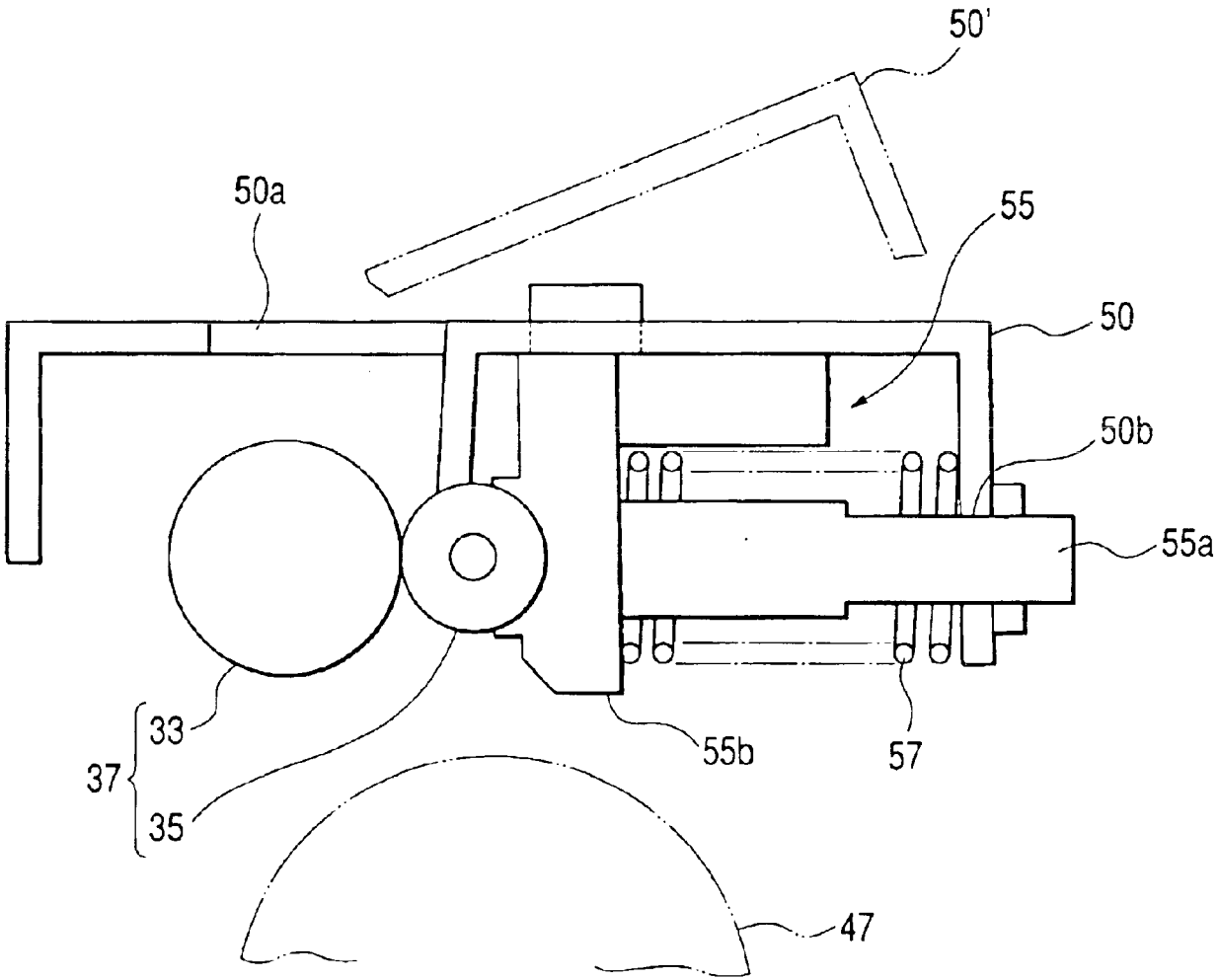
FIG. 13 is a side view of a clamp roller.
Figure 14:
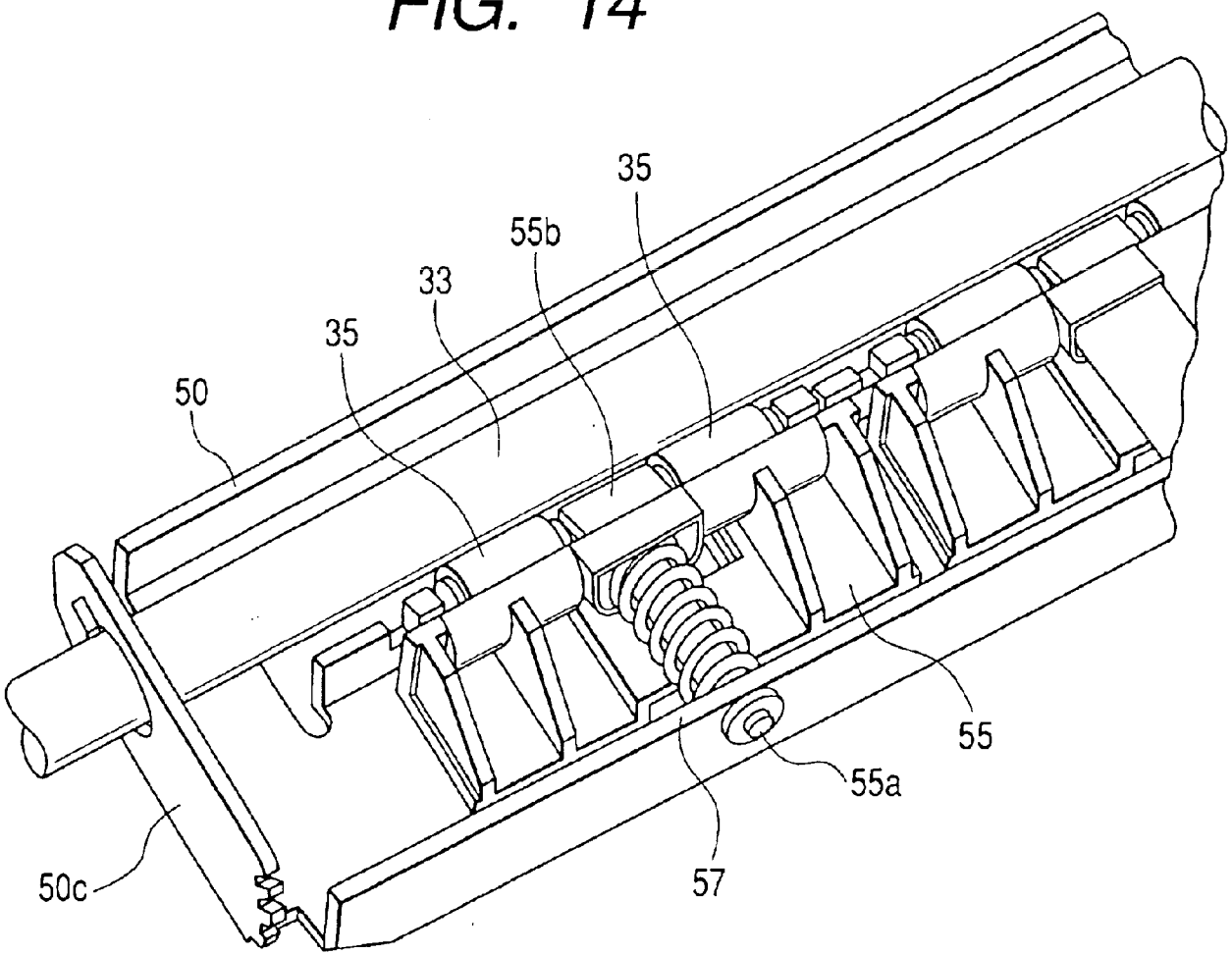
FIG. 14 is an external perspective view of a driven roller holder.
Figure 15A:
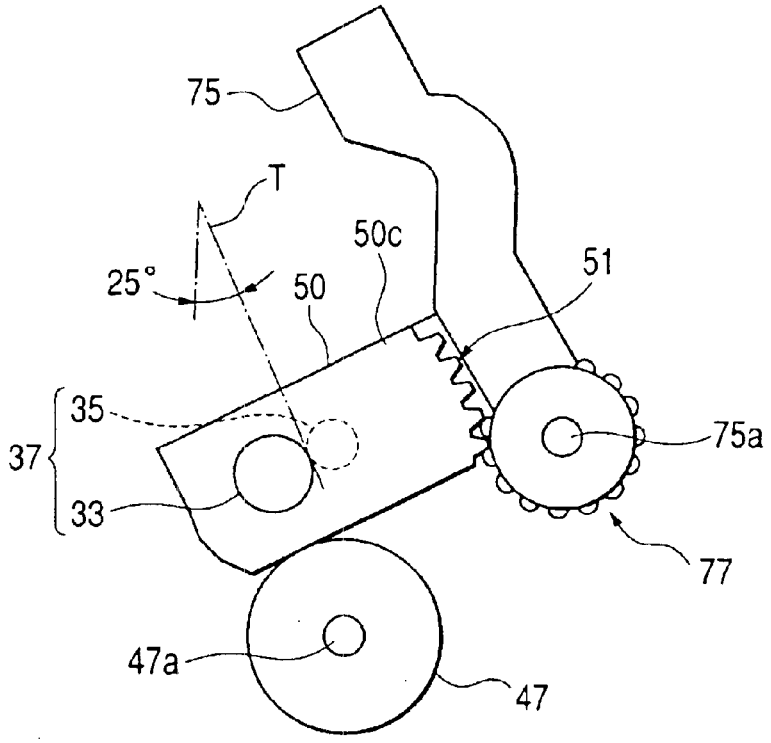
FIGS. 15A and 15B are side views of the swing frame.
Figure 15B:
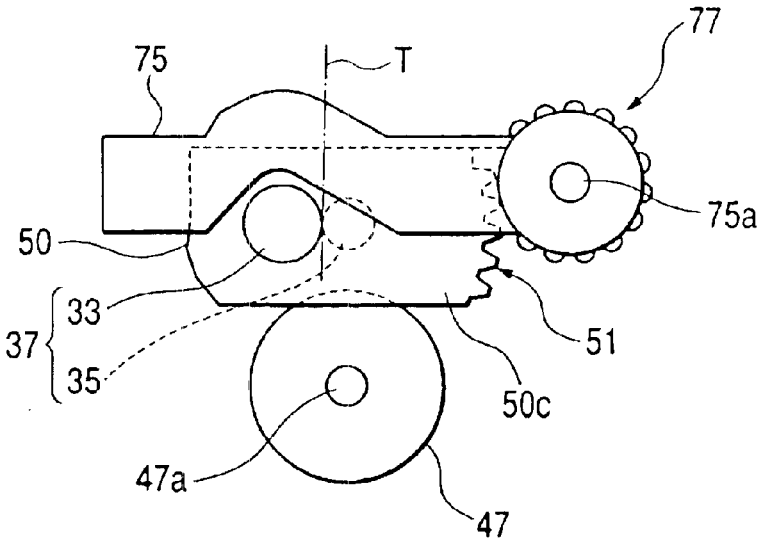
Figure 16:
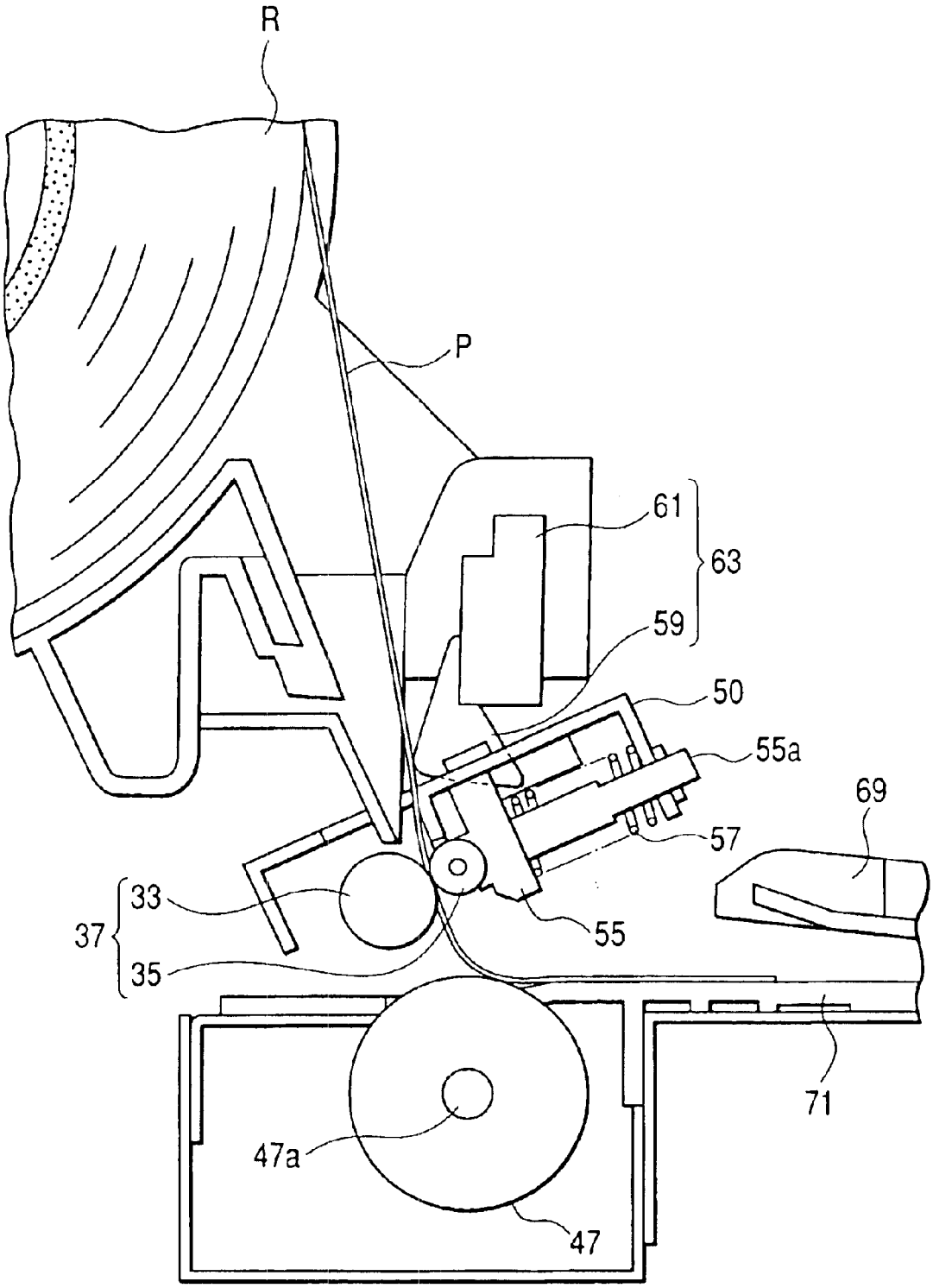
FIG. 16 is a sectional side view of the curl correction device according to the third embodiment of the invention.
Figure 17:
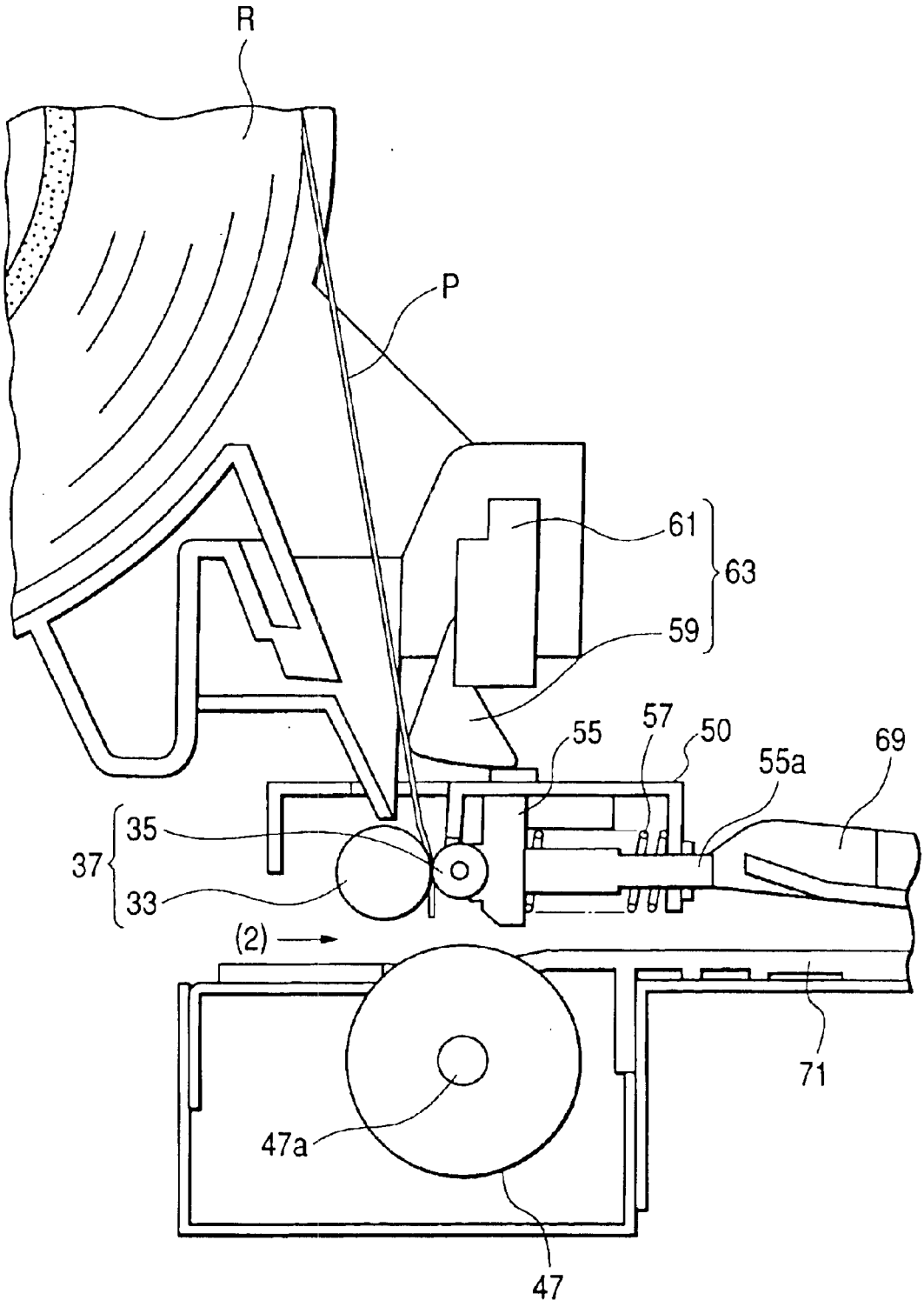
FIG. 17 is a sectional side view of the curl correction device according to the third embodiment of the invention.
Figure 18A:
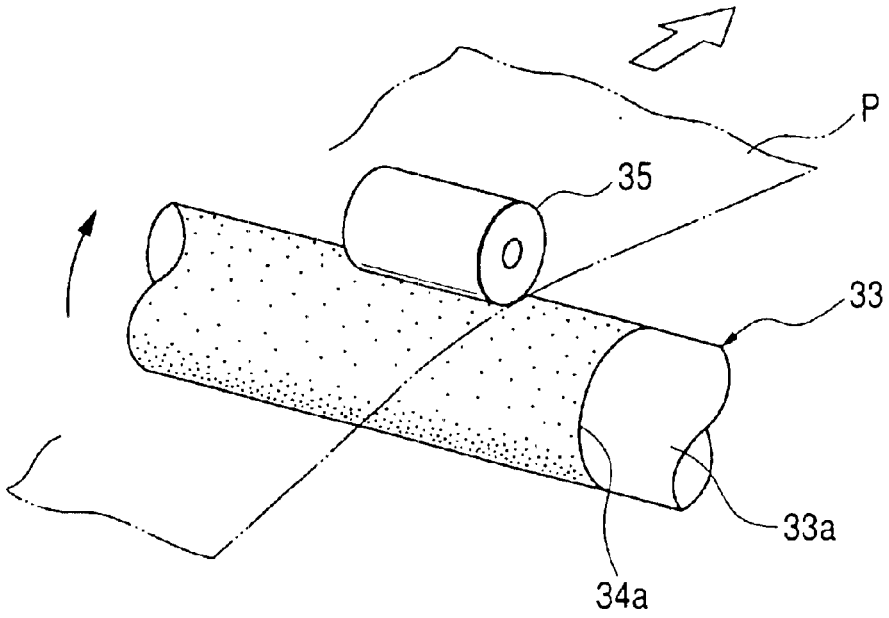
FIGS. 18A and 18B are perspective views to show another embodiment of the clamp roller of the curl correction device according to the third embodiment of the invention.
Figure 18B:
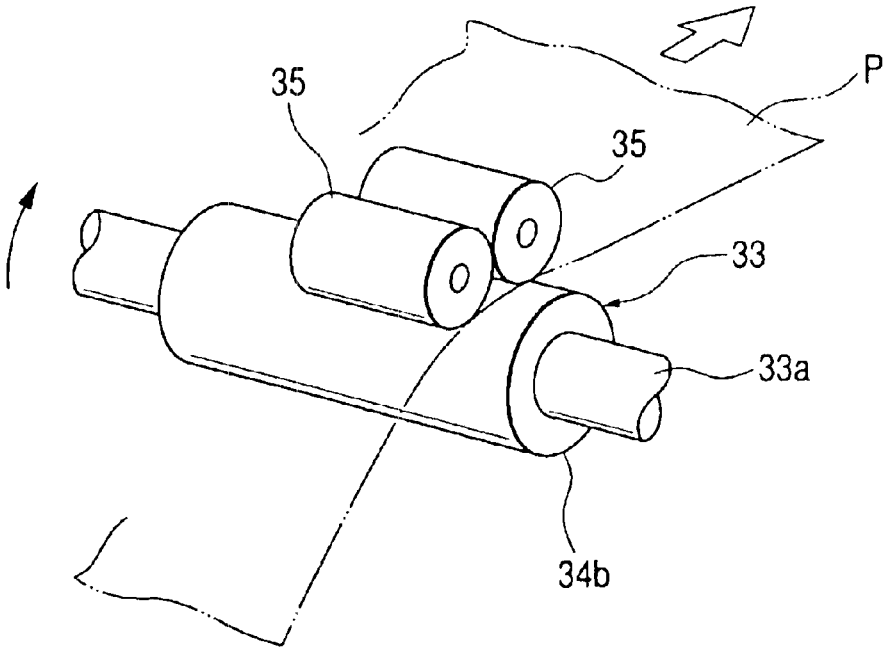
Figure 19A:
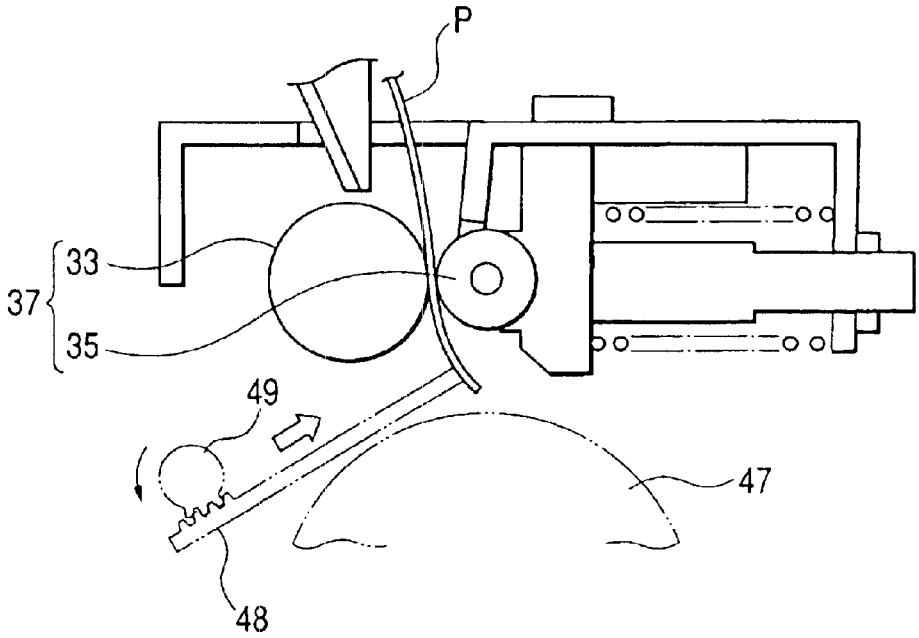
FIGS. 19A and 19B are sectional side views to show another embodiment of an auxiliary roller of the curl correction device according to the third embodiment of the invention.

Next, the configuration of the curl correction device 2 will be discussed in detail with reference to FIGS. 11 to 19B and other accompanying drawings whenever necessary. FIG. 11 is a sectional side view of the curl correction device 2, FIG. 12 is an external perspective view of a swing frame 50, FIG. 13 is an enlarged sectional side view of the portion of the clamp roller 37, FIG. 14 is an external perspective view of a driven roller holder 57, and FIGS. 15A and 15B are side views of the swing frame 50. FIG. 16 is a sectional side view of the curl correction device 2 in a state in which the roll paper rush angle into the auxiliary roller 47 is changed, and FIG. 17 is a sectional side view of the curl correction device 2 in a state in which the roll paper P tip is placed on the auxiliary roller 47. Further, FIGS. 18A and 18B are perspective views to show another embodiment of the clamp roller 37 and FIGS. 19A and 195 are sectional side views to show another embodiment of the auxiliary roller 47.

To begin with, an outline of the curl correction device 2 will be discussed. The curl correction device 2 is a device for correcting curl of the roll paper P paid out from the roll R by a curve means for curving the roll paper P in an opposite direction to the curl. In FIG. 11, the curl correction device 2 comprises the clamp roller 37 for clamping and transporting the roll paper P paid out from the roll R and the auxiliary roller 47 placed in the downstream proximity of the clamp roller 37, and the rollers make up the curve means.

More particularly, the clamp roller 37 is made up of a drive roller 33 rotated and a driven roller 35 having a peripheral surface for coming in contact with the peripheral surface of the drive roller 33 in a press contact state and disposed so that the position of the driven roller pressed against the drive roller 33 can be changed. The clamp roller 37 clamps roll paper P by the drive roller 33 and the driven roller 35 and pays out the roll paper P toward the downstream auxiliary roller 47 as the drive roller 33 is rotated. The roll paper P paid out by the clamp roller 37 abuts the outer peripheral surface of the auxiliary roller 47 as a "guide face" and is curved and is changed in direction substantially horizontally. The roll paper P further proceeds downstream while it is guided as the auxiliary roller 47 is rotated.

The drive roller 33 and the auxiliary roller 47 are both rotated by the drive motor 81 (see FIG. 10) and can be changed in rotation speed or rotation direction as desired under the control of the control section 4 (see FIG. 10). The configuration of the power transmission unit fro transmitting power from the drive motor 81 to the rollers will be discussed later in detail.

The roll paper P paid out from the roll R in the printer 1 has curl made upward convex and is given a curve condition made downward convex when the roll paper P abuts the auxiliary roller 47 and is changed in advance direction. Therefore, the curl of the roll paper P is corrected and after print, the curl is removed or decreased and the good print result can be provided. When the curve condition is given, no components come in contact with the inside of the curve part, so that there is no fear of damaging the print side of the roll paper P and it is made possible to make a better curl correction.

Thus, the auxiliary roller 47 serves the function as a "curve formation section" for curving the roll paper P in an opposite direction to the curl. The rush angle of the roll paper P from the clamp roller 37 into the auxiliary roller 47 or the distance between the clamp roller 37 and the auxiliary roller 47 (disposition interval) becomes a factor for changing the curvature of the curve condition given to the roll paper P and therefore it is made possible to adjust the curl correction degree by adjusting the factor. If the speed of the roll paper P passing through the auxiliary roller 47 is changed, the time giving the curve condition to the roll paper P is changed and therefore it is also made possible to adjust the curl correction degree by adjusting the feed speed of the roll paper P by the clamp roller 37 (circumferential velocity of the clamp roller 37: $V_A$). Therefore, the device for thus adjusting the curl correction degree becomes "correction amount adjustment mechanism" in the curl correction device 2.

The roll paper detector 63 is placed upstream from the clamp roller 37. The roll paper detector 63 comprises a detection section main unit 61 and a detection lever 59. The detection lever 59 is placed in a state in which it projects from the detection section main unit 61 into the passage of the roller paper P. As the roll paper P passes through, the detection lever 59 is pressed against the detection section main unit 61, thereby detecting passage of the roll paper P and transmitting a detection signal to the control section 4. Therefore, for example, when roll paper P is set initially in the curl correction device 2, it is made possible to start rotating the clamp roller 37 for loading the roll paper P in a given time (for example, two seconds) after the roll paper detector 63 detects passage of the roll paper P.

The description of the outline of the curl correction device 2 is now complete.

Next, the configuration of the clamp roller 37 will be discussed in detail. The curl correction device 2 comprises a swing frame 50 long in the width direction of the paper roll P, as shown in FIG. 12. The swing frame 50 is angular U-shaped in cross section so as to cover the drive roller 33 and the driven roller 35 from above, as shown in FIG. 13. The swing frame 50 is formed on the upper face with a groove hole 50*a* long in the width direction of the paper roll P, and the paper roll P is entered in the groove hole 50*a* from above and is nipped between the drive roller 33 and the driven roller 35.

The drive roller 33 is formed of a shaft body long in the width direction of the paper roll P and as shown in FIG. 12, is inserted through fold parts 50*b* and 50*c* (see FIG. 14) at both ends of the swing frame 50, whereby the swing frame 50 can be swung between a state shown by the solid line in FIG. 13 and a state shown by numeral 50' and the phantom line with the drive roller 33 as a swing shaft.

The driven roller 35 is placed on the front of the device relative to the drive roller 33 (the right of FIG. 13) and a plurality of driven rollers 35 are disposed over the axial direction of the drive roller 33 (see FIG. 14). As shown in FIG. 13, each driven roller 35 is journaled by a driven roller holder 55 for rotation and the driven roller holder 55 is disposed in the swing frame 50 in such a manner that it can advance to and retreat from the drive roller 33.

More particularly, as shown in FIGS. 13 and 14, the driven roller holder 55 has a journal part 55*b* for journaling two driven rollers 35 along the axial direction of the drive roller 33 and a slide shaft 55*a* extending in the direction in which the driven roller 35 should retreat (to the right of FIG. 13) from the midposition of the two driven rollers 35 in the journal part 55*b*. The slide shaft 55*a* pierces the angular U shape of the swing frame 50 from the inside to the outside, and a coil spring 57 is inserted into the slide shaft 55*a* for giving a spring force to the inside of the swing frame 50 and the journal part 55*b*. Therefore, it is made possible for the driven roller holder 55 to advance to and retreat from the drive roller 33, and the peripheral surface of the driven roller 35 is always pressed against the peripheral surface of the drive roller 33 by the coil spring 57.

Next, the fold part 50*c* forming one end of the swing frame 50 is formed with a gear part 51 comprising a continuous uneven shape as shown in FIGS. 15A and 15B. On the other hand, a frame member (not shown) forming a part of the curl correction device 2 is formed with a gear 77 meshing with the gear part 51 for rotation with a rotation shaft 75*a* as the center. An operation lever 75 is attached to the gear 77 (also see FIG. 12). The operation lever 75 is operated, whereby the gear 77 is rotated and accordingly the swing frame 50 is swung as shown in FIGS. 15A and 15B.

Since the driven roller 35 is journaled by the driven roller holder 55 attached to the swing frame 50, as the swing frame 50 is swung with the drive roller 33 as the swing shaft, the driven roller 35 is displaced around the drive roller 33 (is planetary-rotated). That is, as the swing frame 50 is swung, the driven roller 35 displaces the position pressed against the drive roller 33 and accordingly the direction in which the roll paper P is paid out (the direction indicated by tangent T in FIGS. 15A and 15B) changes and it is made possible to adjust the curl correction degree of the roll paper P.

The operation lever 75 in the embodiment can be changed by snap fit means (not shown) stepwise to a state shown in FIG. 15B, namely, a state in which the tangent T in the contact between the peripheral surface of the drive roll 33 and the peripheral surface of the driven roll 35 (the direction in which the roll paper P is paid out) is vertical, a state shown in FIG. 15A, namely, a state in which the tangent T is inclined 25.0 deg from the vertical state (the tangent T is inclined in the direction from the device rear top to the device front bottom (from the upper left of FIG. 15A to the lower right)), and an intermediate state of the two states.

By the way, the drive roll 33 is formed of a shaft body long in the width direction of the paper roll P as described above. FIG. 18A shows the state of the peripheral surface of the drive roll 33. As shown in FIG. 18A, the drive roll 33 according to the embodiment has a high-friction layer 34*a* comprising abrasive resistance particles (for example, ceramic particles) fixed by an adhesive to the outer peripheral surface of shaft body 33*a* long in the width direction of the paper roll P, and the roll paper P is pressed against the high-friction layer 34*a* by the driven roller 35, so that the roll paper P is reliably transported without slip. However, not only the configuration, but also the configuration, for example, as shown in FIG. 18B is possible wherein a rubber roller 34*b* is disposed on the shaft body 33*a* long in the width direction of the paper roll P and the roll paper P is pressed against the rubber roll 34*b* by a plurality of (in FIG. 18B, two) driven rollers 35 disposed along the circumferential direction and is transported. In this case, the drive roller 33 can be formed of rubber roller and thus the cost of the drive roller 33 can be reduced.

Next, the configuration of the auxiliary roller 47 will be discussed. As previously described with reference to FIG. 11, the auxiliary roller 47 is disposed at a position in the downstream proximity of the clamp roller 37 at which it can abut the roll paper P paid out from the clamp roller 37. As shown in FIG. 12, a plurality of (in the embodiment, six) auxiliary rollers 47 are attached over the axial direction of a shaft body 47*a* long in the width direction of the paper roll P.

The auxiliary roller 47 is rotated in the advance direction of the roll paper P (clockwise in FIG. 11) to correctly downward guide the roll paper P paid out from the clamp roller 37. That is, the tip of the roll paper P abuts the peripheral surface of the auxiliary roller 47 and is curved and advances downward. Thus, if the rush angle of the roll paper P into the auxiliary roller 47 is steep (for example, in a state as shown in FIG. 15B), it is feared that the tip of the roll paper P may advance in an opposite direction (device rear) to the direction in which it should advance (device front), causing a paper jam to occur. Therefore, to prevent this, the auxiliary roller 47 is rotated in the advance direction of the roll paper P, thereby reliably guiding the tip of the roll paper P in the correct direction.

The rotation speed of the auxiliary roller 47 in the embodiment, more particularly, the circumferential velocity of the outer periphery of the auxiliary roller 47, $V_B$, is set larger than the circumferential velocity of the clamp roller 37, $V_A$. That is, the paper feed speed of the auxiliary roller 47 is set larger than that of the clamp roller 37 and thus it is made possible to guide the tip of the roll paper P more reliably in the correct direction. In the embodiment, $V_B$ is set equal to 2 $V_A$, whereby the above-described advantage can be provided reliably; however, if $V_B$ is set equal to or greater than $V_A$, it is made possible to provide the above-described advantage.

If the outer peripheral surface of the auxiliary roller 47 is formed of an elastic material (rubber material in the embodiment), it is made possible to provide the above-described advantage at a low cost.

Figure 19B:
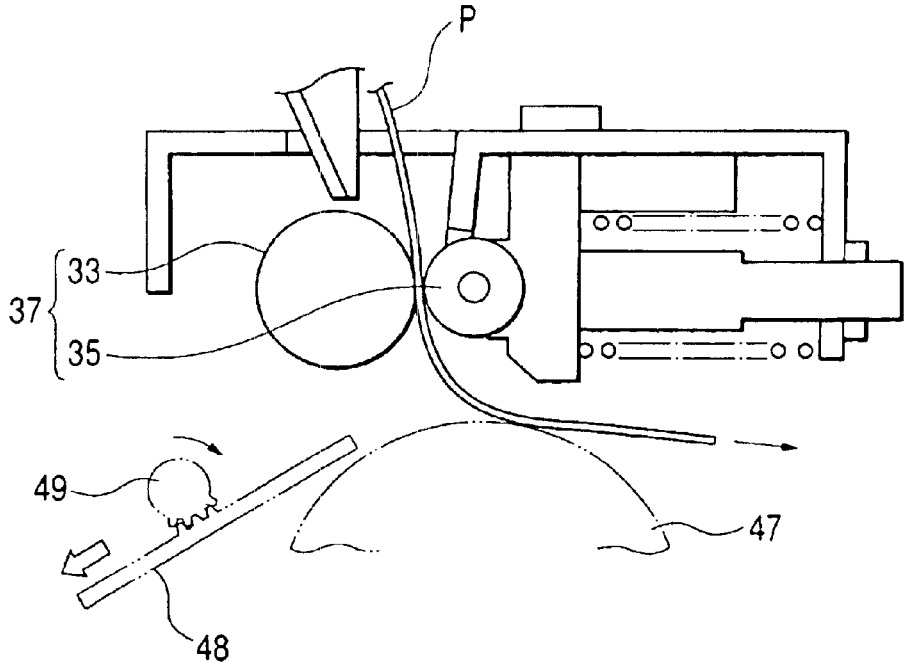

The guide function of the tip of the roll paper P by the auxiliary roller 47 as described above can also be provided according to a configuration as shown in FIGS. 19A and 19B. In FIGS. 19A and 19B, a butt rod 48 and a gear 49 are disposed on the device rear side of the auxiliary roller 47. The upper face of the butt rod 48 is made uneven and therefore as the gear 49 is rotated counterclockwise in FIGS. 19A and 19B by a rack mechanism, the butt rod 48 advances toward the roll paper P as shown in FIG. 19A and as the gear 49 is rotated clockwise in FIGS. 19A and 19B, the butt rod 48 retreats from the roll paper P as shown in FIG. 19B. Therefore, when the tip of the roll paper P abuts the auxiliary roller 47, if the butt rod 48 is butt against the tip of the roll paper P from the back thereof as shown in FIG. 19A, it is made possible to allow the tip of the roll paper P correctly to flow downward as shown in FIG. 19B.

Next, other advantages of the described curl correction device 2 will be discussed with reference to FIG. 11 and other accompanying drawings whenever necessary. To begin with, the clamp roller 37 is made up of the drive roller 33 rotated and the driven roller 35 having a peripheral surface for coming in contact with the peripheral surface of the drive roller 33 in a press contact state and disposed so that the position of the driven roller pressed against the drive roller 33 can be changed, as described above. Thus, if the operation lever 75 (see FIG. 12 or FIGS. 15A and 15B) is operated for displacing the driven roller 35, the angle at which the roll paper P advances to the auxiliary roller 47 can be changed as desired. That is, the curvature to curve the roll paper P can be changed as desired and therefore if the driven roller 35 is displaced in response to the quality, the use environment, etc., of the roll paper P, it is made possible to make a more appropriate curl correction.

Particularly, if the curl correction degree is high, a phenomenon in which the roll paper P is curved in an opposite direction to the initial curl occurs (which will be hereinafter referred to as "overdecurl"). If overdecurl occurs in the tip portion of the roll paper P, it is feared that the tip of the roll paper P may come in contact with the record head 21, making the print side dirty or may not correctly be nipped into the first paper ejection roller 26 or the second paper ejection roller 27, resulting in a paper jam. Then, if the driven roller 35 is displaced for adjusting the curl correction degree in response to the quality of the roll paper P, such a problem can be prevented.

Next, at the position of the driven roller 35 such that the clamp roller 37 pays out the roll paper P vertically downward (in the state shown in FIG. 15B), the angle between the roll paper P paid out from the clamp roller 37 and the roll paper P passing through the auxiliary roller 47 form substantially a right angle with the transport passage as a side view (see FIG. 11). Therefore, the advance direction of the roll paper P is changed at a steep angle and accordingly a curve state with a small curvature is formed in the roll paper P, so that if the roll paper P is like thick coated paper providing photo image quality, it is made possible to correct curl reliably at the position of the driven roller 35.

In the embodiment, the passage length from the nip point between the drive roller 33 and the driven roller 35 to the contact with the outer peripheral surface of the auxiliary roller 47 is set to 8 mm or less at the position of the driven roller 35 such that the clamp roller 37 pays out the roll paper P vertically downward (in the state shown in FIG. 15B), so that the curve state formed in the roll paper P becomes still stronger and therefore the curl is corrected reliably.

Next, the curl correction device 2 according to the embodiment corrects the curl of the tip portion of the roll paper P more moderately than the curl of the portion following the tip portion. More particularly, the circumferential velocity of the clamp roller 37 when the tip portion of the roll paper P passes through the auxiliary roller 47, $V_{A1}$, is set larger than the circumferential velocity of the clamp roller 37 when the portion following the tip portion of the roll paper P passes through the auxiliary roller 47, $V_{A2}$.

That is, as the problem involved in overdecurl, the overdecurled roll paper P tip is caught in a position in the paper passage or rubs against the record head 21 and therefore if the overdecurl of only the tip portion of the roll paper P is decreased or removed, it is made possible to perform the normal print operation and provide the normal print quality although the overdecurl of the portion following the tip portion of the roll paper P is noticeable to some extent. From such a viewpoint, in the embodiment, the curl of the tip portion of the roll paper P is corrected more moderately than the curl of the portion following the tip portion of the roll paper P by the device described above. Therefore, for example, if the curvature of the curve formation part is set small by setting small the disposition interval between the clamp roller 37 and the auxiliary roller 47, etc., to reliably correct the curl considering that the curl of the roll start portion of the roll R is strong, the curl of the tip portion of the roll paper P is corrected moderately, so that the overdecurl of the tip portion of the roll paper P is decreased or prevented and thus it is made possible to provide the appropriate print result.

In the embodiment, the curl correction degree is adjusted by adjusting the circumferential velocity of the clamp roller 37, $V_A$, as described above, so that the dedicated component for adjusting the curl correction degree becomes unnecessary and thus the costs of the curl correction device 2 can be reduced. However, the device for adjusting the curl correction degree is not limited to the device described above; a similar advantage can also be provided, for example, by setting curvature $R_1$ when the tip portion of the roll paper P passes through the auxiliary roller 47 larger than curvature $R_2$ when the portion following the tip portion of the roll paper P passes through the auxiliary roller 47.

More specifically, the driven roller 35 manually displaced in the embodiment can also be displaced automatically using the power of a motor, etc., thereby changing the rush angle of the roll paper P into the auxiliary roller 47 or the clamp roller 37 can also be made to advance to and retreat from the auxiliary roller 47 for changing the passage length between the clamp roller 37 and the auxiliary roller 47. Particularly, if the roll paper P is thick, the transport load when the tip portion of the roll paper P initially passes through the auxiliary roller 47 becomes large and it is feared that the circumferential velocity of the clamp roller 37, $V_{A1}$, may be unable to be set sufficiently large. However, according to the device for adjusting the curvature R when the roll paper P passes through the auxiliary roller 47 as described above, if the roll paper P is thick, the roll paper P can be allowed to pass through the auxiliary roller 47 reliably without any strain at a moderate curvature, so that it is made possible to decrease or prevent the overdecurl of the tip portion of the roll paper P.

In addition, the curl correction device 2 according to the embodiment controls driving the clamp roller 37 for placing the tip of the roll paper P upstream from the auxiliary roller 47 (the state shown in FIG. 17) before the clamp roller 37 enters a nonoperating state in which it does not perform the paper feed operation (transport operation) of the roll paper P. The reason is as follows: If the roll paper P is left set in the paper passage of the curl correction device 2 for a long period of time, a curve is left in the portion curved by the auxiliary roller 47 and therefore when the next print is started, various problems will arise such that the portion in which the curved is left is caught in a position in the paper passage, resulting in a paper jam or that the distance from the record head 21 becomes nonuniform, lowering the print quality.

The first paper feed passage for feeding the roll paper P and the second paper feed passage for substantially horizontally manually feeding thick paper that cannot pass through the curved paper transport passage cross each other and merge in the curl correction device 2 as described above. Thus, when the roll paper P is set in the curl correction device 2, namely, when the roll paper P exists in the paper passage between the clamp roller 37 and the auxiliary roller 47, the second paper feed passage cannot be used and therefore to use the second paper feed passage, the roll paper P must be previously removed.

Then, the curl correction device 2 according to the embodiment controls driving the clamp roller 37 for placing the tip of the roll paper P upstream from the auxiliary roller 47 before the clamp roller 37 enters the nonoperating state in which it does not perform the transport operation of the roll paper P, thereby releasing the second paper feed passage. Thus, the roll paper P is not formed with a curve state for curl correction over a long period of time, a curve is not left in the roll paper P, and when the second paper feed passage is next used, it is made possible to immediately execute print without requiring any special work.

The nonoperating state in which the clamp roller 37 does not perform the transport operation of the roll paper P means a state in which the paper feed operation of the roll paper P by the clamp roller 37 does not follow (a state in which the time to the next paper feed operation is undefined) and, for example, refers to a state in which a print job sequence terminates, not followed by another print job in the printer 1.

By the way, when placing the tip of the roll paper P upstream from the auxiliary roller 47 before entering the nonoperating state, the curl correction device 2 holds the state in which the tip of the roll paper P is clamped in the clamp roller 37. Therefore, when the next paper feed operation is started, the work for inserting the tip of the roll paper P into the clamp roller 37 becomes unnecessary, so that it is made possible to easily execute the next paper feed operation of the roll paper P.

<<3. Configuration and Function of Power Transmission Unit>>

Figure 20:
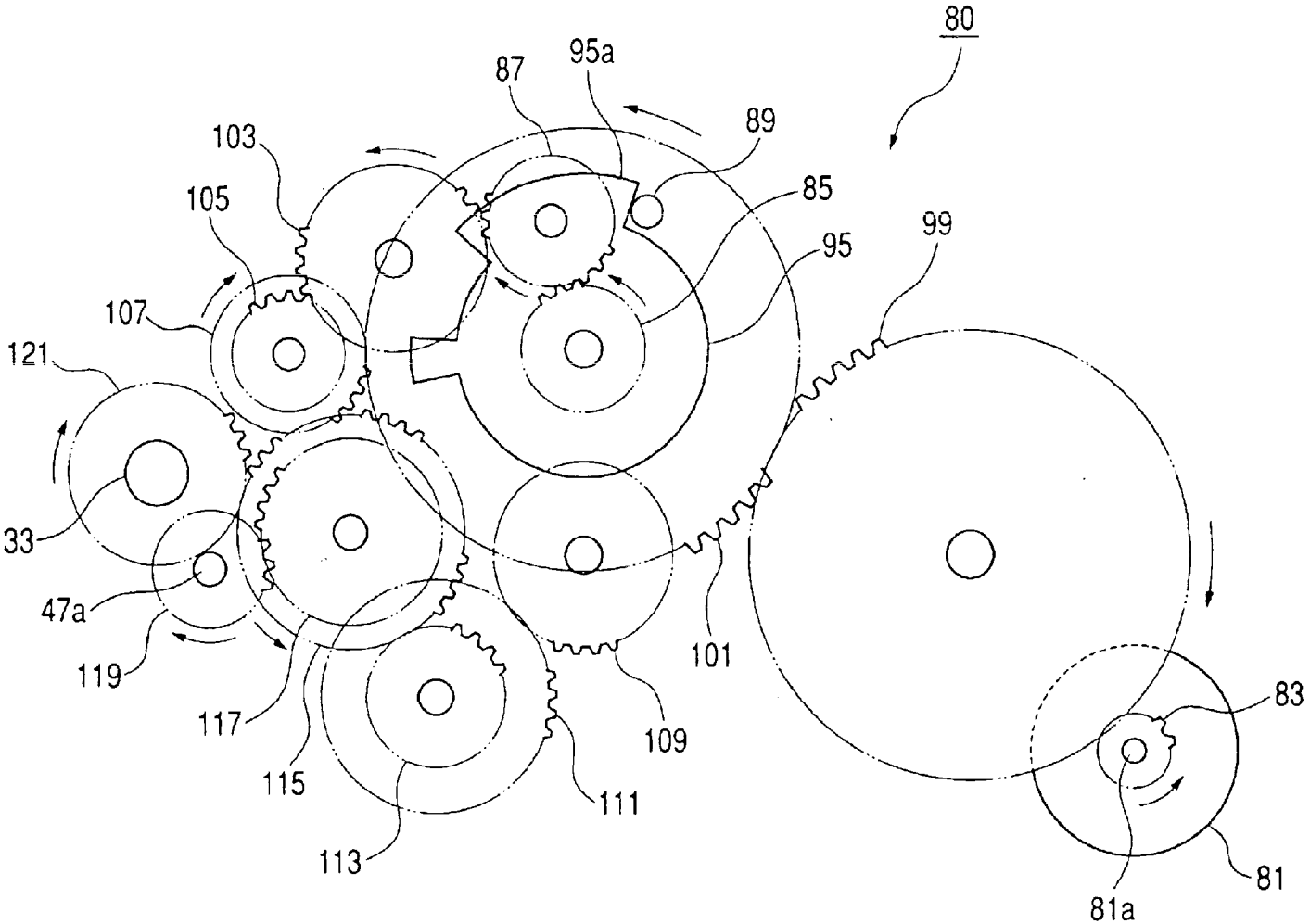
FIG. 20 is a front view of gear train of a power transmission unit according to the invention.
Figure 21:
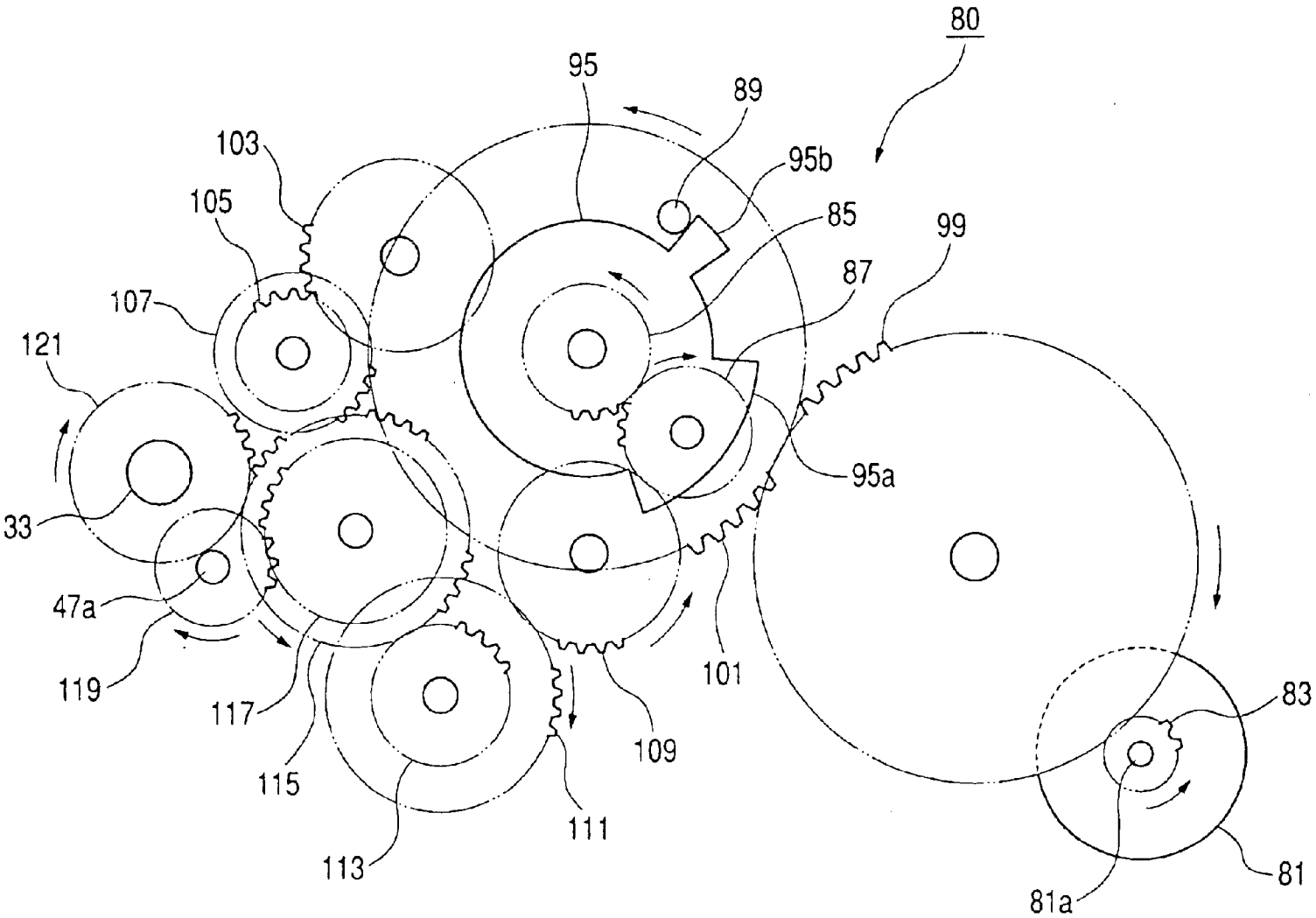
FIG. 21 is a front view of gear train of the power transmission unit according to the invention.
Figure 22A:
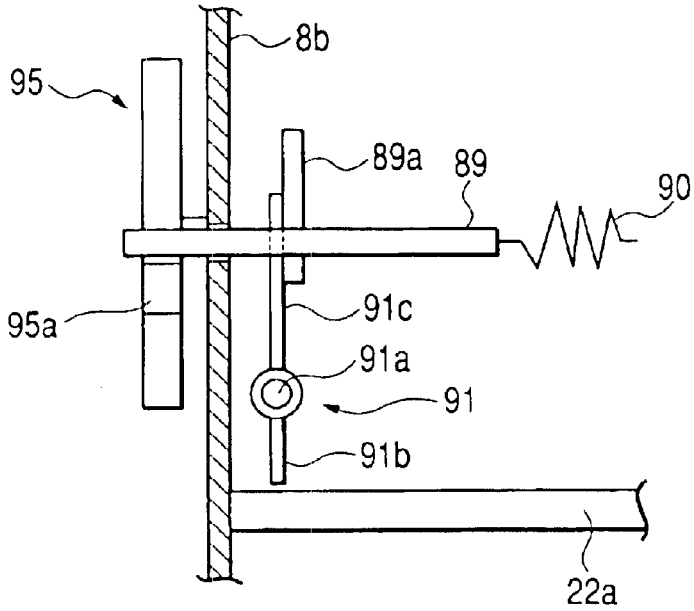
FIGS. 22A and 22B are schematic representations to show the operation of a stopper pin.
Figure 22B:
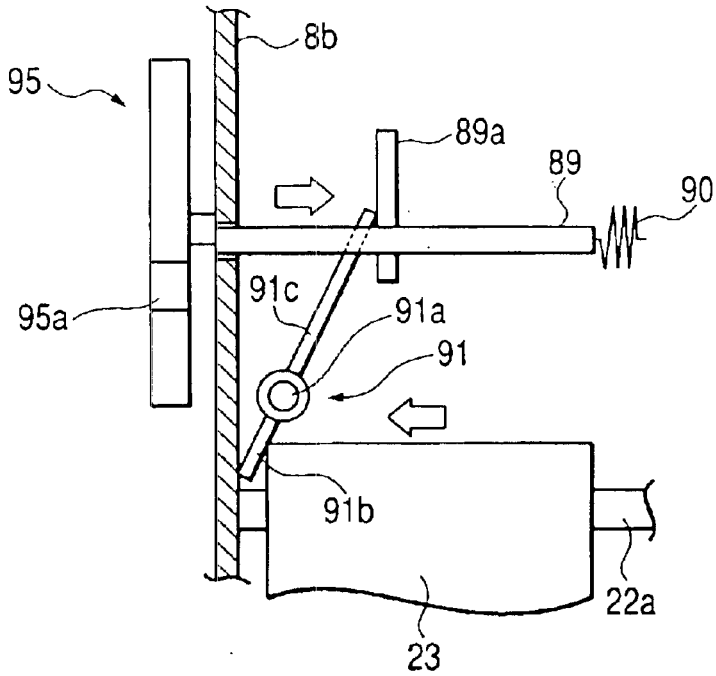
Figure 23A:
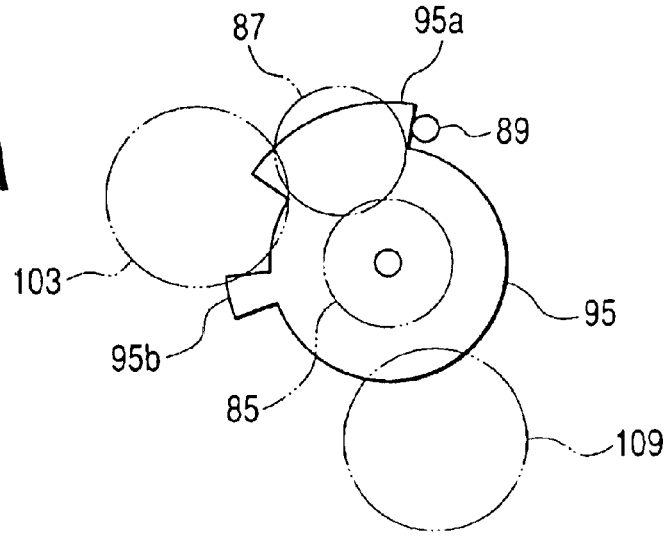
FIGS. 23A, 23B, and 23C are schematic representations to show the operation of a planetary lever.
Figure 23B:
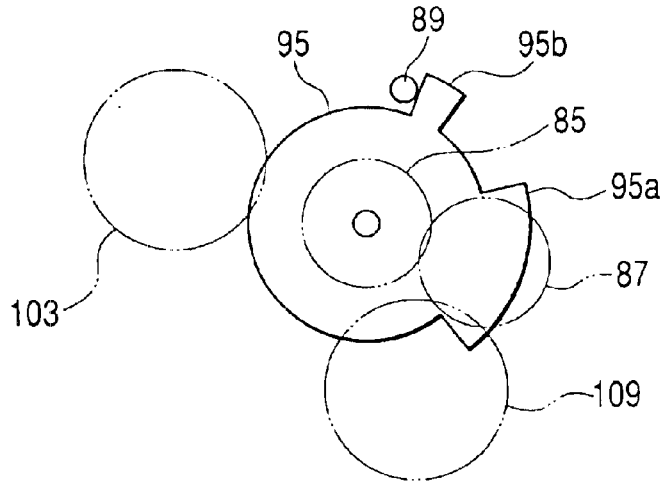
Figure 23C:
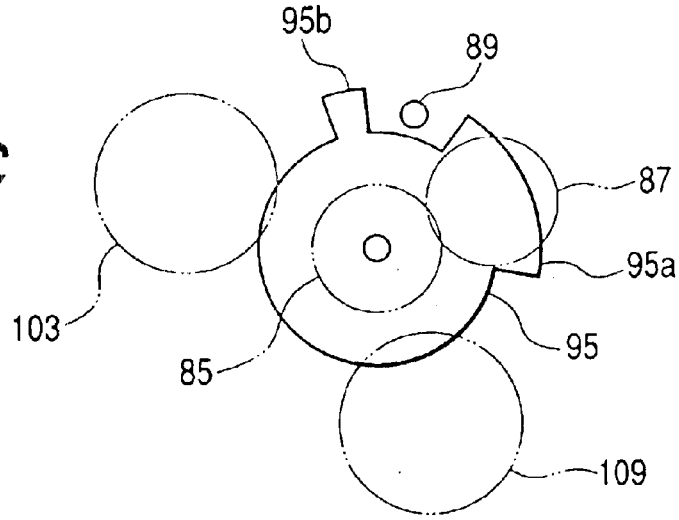

The configuration and function of a power transmission unit 80 for transmitting power from the drive motor 81 to the clamp roller 37 and the auxiliary roller 47 will be discussed with reference to FIG. 20 to FIG. 23C. FIGS. 20 and 21 are front views of gear trains forming a part of the power transmission unit 80, FIGS. 22A and 22B are schematic representations to show the operation of a stopper pin 89 (described later), and FIGS. 23A, 23B, and 23C are schematic representations to show the operation of a planetary lever 95 (described later).

To begin with, an outline of the power transmission unit 80 will be discussed. The power transmission unit 80 is placed on the left side frame 8*b* forming a part of the base of the printer 1 as shown in FIG. 8. The drive motor 81 is fixed on the front of the left side frame 8*b* (the right of FIG. 20) so that a rotation shaft 81*a* of the drive motor 81 is orthogonal to the plane of the left side frame 8*b*. A plurality of gears are placed on the left side frame 8*b* so that the disk side becomes parallel with the plane of the left side frame 8*b*, making up a gear train of the power transmission unit 80. Power is transmitted through the gear train from a pinion gear 83 attached to the rotation shaft 81*a* to a drive roller gear 121 (see FIG. 12) attached to a shaft end of the drive roller 33 and an auxiliary roller gear 119 attached to a shaft end of the auxiliary roller shaft 47*a*, the drive roller gear 121 and the auxiliary roller gear 119 being placed on the rear of the left side frame 8*b* (the left of FIG. 20).

The power transmission unit 80 has two power transmission passages of a first power transmission passage (gear train) for transmitting power in the left direction from a transmission gear 103 and a second power transmission passage (gear train) for transmitting power in the left direction from a transmission gear 109 as power transmission passages to the drive roller gear 121 and the auxiliary roller gear 119 and further has power transmission switch device for selectively switching to either of the two power transmission passages. FIG. 20 shows a state in which the rotation power of the drive motor 81 is transmitted using the first power transmission passage and FIG. 21 shows a state in which the rotation power is transmitted using the second power transmission passage; the arrows in the figures indicate the rotation directions of the gears. The description of the outline of the power transmission unit 80 is now complete.

The detailed configurations of the first power transmission passage, the second power transmission passage, and the power transmission switch device will be discussed. To begin with, in FIG. 20, the first power transmission passage is made up of transmission gears 103, 105, 107, 115, and 117 and the power of the drive motor 81 is transmitted in this order. Finally, the transmission gear 115 transmits the power to the drive roller gear 121 and the transmission gear 117 transmits the power to the auxiliary roller gear 119. The power is transmitted to the top transmission gear 103 of the gear train by a planetary gear 87.

Next, in FIG. 20, the second power transmission passage is made up of transmission gears 109, 111, 113, 115, and 117 and the power of the drive motor 81 is transmitted in this order. Finally, the transmission gear 115 transmits the power to the drive roller gear 121 and the transmission gear 117 transmits the power to the auxiliary roller gear 119 as with the first power transmission passage. The power is transmitted to the top transmission gear 109 of the gear train by the planetary gear 87 as with the first power transmission passage.

The planetary gear 87 always meshes with a sun gear 85 and planetary-rotates (revolves) around the sun gear 85. The sun gear 85 and a transmission gear 101 form a double gear and the rotation power of the drive motor 81 is transmitted in the order of the pinion gear 83, a transmission gear 99, the transmission gear 101, and the sun gear 85 and the planetary gear 87 rotates (on its axis).

The planetary gear 87 is journaled by the planetary lever 95 which has the same rotation center as the sun gear 85 and can freely rotate independently of the sun gear 85. The planetary lever 95 is shaped like a disk and is formed in an outer peripheral part with a first engagement part 95*a* and a second engagement part 95*b* each shaped like a fan with the diametrical dimension enlarged, as shown in FIGS. 20 and 21. The second engagement part 95*b* is placed on the counterclockwise side in FIG. 20 from the first engagement part 95*a* and is shaped with the circumferential dimension smaller than that of the first engagement part 95*a*. The planetary gear 87 is attached to the first engagement part 95*a*.

Thus, as the planetary lever 95 rotates, the planetary gear 87 planetary-rotates around the sun gear 85, whereby the planetary gear 87 switches the mesh state between the mesh state with the transmission gear 103 (first power transmission passage) and the mesh state with the transmission gear 109 (second power transmission passage). That is, the planetary lever 95 and the planetary gear 87 make up the power transmission switch device.

Next, stopper device for fixing the planetary lever 95 to the position of the planetary lever 95 at which the planetary gear 87 meshes with the transmission gear 103 (which will be hereinafter referred to as first joint position) and the position of the planetary lever 95 at which the planetary gear 87 meshes with the transmission gear 109 (which will be hereinafter referred to as second joint position) will be discussed. As shown in FIGS. 22A and 22B, the stop pin 89 extending in a direction orthogonal to the left side frame 8*b* is placed so that it pierces the left side frame 8*b* and can advance to and retreat from the planetary lever 95.

The stopper pin 89 is always urged by an urging spring 90 in a direction in which it advances to the planetary lever 95. In the state in which the stopper pin 89 advances to the planetary lever 95, the tip part of the stopper pin 89 is placed in a state in which it can engage the first engagement part 95*a* or the second engagement part 95*b* formed in the outer peripheral part of the planetary lever 95 as shown in FIG. 22A (also see FIGS. 20 and 21). Therefore, the rotation operation of the planetary lever 95 is regulated in the state in which the stopper pin 89 advances to the planetary lever 95. Thus, the first engagement part 95*a* and the second engagement part 95*b* of the planetary lever 95 and the stopper pin 89 make up the stopper device for fixing the planetary lever 95 to the first joint position and the second joint position.

On the other hand, in the inside of the left side frame 8*b* (the right of FIGS. 22A and 22B), a release lever 91 having a rotation shaft 91*a* parallel in the vertical direction (front and back direction of the planes of FIGS. 22A and 22B) is placed on the device front side (the lower sides of FIGS. 22A and 22B) from the stopper pin 89. The release lever 91 has a lever part 91*c* extending from the rotation shaft 91*a* to the stopper pin 89 and a carriage engagement part 91*b* extending from the rotation shaft 91*a* in an opposite direction to the lever part 91*c*. The lever part 91*c* can engage a lever engagement part 89*a* formed on the stopper pin 89. Therefore, as the release lever 91 rotates on the rotation shaft 91*a*, the lever part 91*c* moves the stopper pin 89 in the retreat direction against the urging force of the urging spring 90, whereby the tip part of the stopper pin 89 is detached from the planetary lever 95 and the planetary lever 95 can freely rotate (state in FIG. 22B).

The advance and retreat operation of the stopper pin 89, namely, the rotation operation of the release lever 91 is performed by the carriage 23. The front side of the release lever 91 (the lower sides of FIGS. 22A and 22B) is an area in which the carriage 23 reciprocates. The carriage engagement part 91*b* extending from the rotation shaft 91*a* is formed so as to project into the reciprocating area of the carriage 23. Therefore, when the carriage 23 moves to the left end of the reciprocating area, namely, the side of the left side frame 8*b*, as change from FIG. 22A to FIG. 22B, the carriage 23 presses the carriage engagement part 91*b*, whereby the release lever 91 rotates ahd accordingly the stopper pin 89 moves in the direction in which it retreats from the planetary lever 95.

Next, the rotation operation of the planetary lever 95 will be discussed in detail. As shown in FIG. 20, at the first joint position, the stopper pin 89 is positioned on the side wall of the first engagement part 95*a* and thus if the sun gear 85 rotates in the direction in which the planetary gear 87 is brought away from the transmission gear 103 (rotates clockwise in FIG. 20), the mesh state with the transmission gear 103 is maintained. If the stopper pin 89 is retreated from the state and the sun gear 85 is rotated clockwise in FIG. 20, the planetary gear 87 is moved away from the transmission gear 103 and soon meshes with the transmission gear 109. In this state, if the stopper pin 89 is advanced to the planetary lever 95, as shown in FIG. 21, the stopper pin 89 is positioned on the side wall of the second engagement part 95*b* and thus if the sun gear 85 rotates in the direction in which the planetary gear 87 is brought away from the transmission gear 109 (rotates counterclockwise in FIG. 21), the mesh state with the transmission gear 109 is maintained.

The function of the described power transmission unit 80 will be discussed. In the power transmission unit 80, the gear trains are formed so that transmission ratio $h_1$ when the rotation power of the drive motor 81 is transmitted through the transmission gear 103 (first power transmission passage) to the auxiliary roller gear 119 and the drive roller gear 121 and transmission ratio $h_2$ when the rotation power of the drive motor 81 is transmitted through the transmission gear 109 (second power transmission passage) to the auxiliary roller gear 119 and the drive roller gear 121 become $h_1=4h_2$. That is, the transmission gear 109 (second power transmission passage) rather than the transmission gear 103 (first power transmission passage) makes it possible to rotate the auxiliary roller gear 119 and the drive roller gear 121 at lower torque.

The reason is as follows: For the curl correction device 2 to correct the curl of the tip portion of the roll paper P more moderately than the curl of the portion following the tip portion, the circumferential velocity of the clamp roller 37 when the tip portion of the roll paper P passes through the auxiliary roller 47, $V_{A1}$, is set larger than the circumferential velocity of the clamp roller 37 when the portion following the tip portion of the roll paper P passes through the auxiliary roller 47, $V_{A2}$, as described above. When the tip of the roll paper P passes through the auxiliary roller 47, the roll paper P must be curved and thus the transport load becomes larger than that when the portion following the tip portion of the roll paper P passes through the auxiliary roller 47 and if the roll paper P is particularly thick photo paper, etc., it is also feared that the circumferential velocity $V_{A1}$ may be unable to be set sufficiently large.

Then, the power transmission unit 80 according to embodiment transmits the power through the transmission gear 109 (second power transmission passage) when the tip portion of the roll paper P passes through, thereby reliably rotating the clamp roller 37 and transmits the power through the transmission gear 103 (first power transmission passage) when the portion following the tip portion of the roll paper P passes through, whereby optimum power transmission can be conducted.

By the way, the power transmission switch device in the power transmission unit 80 comprises a non-joint position where the planetary gear 87 is joined to neither the transmission gear 103 (first power transmission passage) nor the transmission gear 109 (second power transmission passage). FIG. 23C shows the non-joint position. The stopper pin 89 engages the side wall of the first engagement part 95*a* away from the second engagement part 95*b*, thereby fixing the planetary lever 95 to the first joint position (state in FIG. 23A) and engages the side wall of the second engagement part 95*b* away from the first engagement part 95*a*, thereby fixing the planetary lever 95 to the second joint position (state in FIG. 23B), as described above. If the timings of the advance and retreat operation of the stopper pin 89 and the rotation operation of the planetary lever 95 are adjusted, the stopper pin 89 can also be placed between the first engagement part 95*a* and the second engagement part 95*b*. In doing so, it is made possible for the planetary gear 87 to maintain a state in which it meshes with neither the transmission gear 103 nor the transmission gear 109, and a state in which the power transmission unit 80 does not give a load to the drive motor 81 can be formed.

That is, since the drive motor 81 drives various components to be driven in the printer 1 as described above (for example, paper delivery drive roller 15 (see FIG. 9)), if the power transmission unit 80 gives a large load to the drive motor 81, it is feared that, for example, the precise delivery operation of the roll paper P by the paper delivery drive roller 15 may be affected, degrading the print quality. However, the power transmission unit 80 can form a no-load state as described above, so that it is made possible to prevent the problem as described above.

Next, the relationship between the paper delivery speed of the roll paper P by the clamp roller 37 ($V_A$: Circumferential velocity of clamp roller 37) and that by the paper delivery roller 19 (see FIG. 9) ($V_C$: Circumferential velocity of paper delivery roller 19) will be discussed.

In FIG. 9, the clamp roller 37 and the paper delivery roller 19 are both rollers which are driven, and the roll paper P receives the paper delivery operation of the two rollers and is precisely delivered. Therefore, the roll paper P is precisely delivered to below the record head 21 by the cooperation of the rollers and to provide the appropriate print result, it becomes important to synchronize the paper delivery operation of the clamp roller 37 and that of the paper delivery roller 19.

Then, in the printer 1, the paper delivery speed of the clamp roller 37 (circumferential velocity of clamp roller 37, $V_A$) is set larger than that of the paper delivery roller 19 (circumferential velocity of paper delivery roller 19, $V_C$). The advantage provided by setting the circumferential velocity of the clamp roller 37, $V_A$, larger than the circumferential velocity of the paper delivery roller 19, $V_C$, will be discussed.

The auxiliary roller 47 is disposed in the downstream proximity of the clamp roller 37 and the roll paper P abuts the auxiliary roller 47, is curved, and goes downstream. Therefore, the auxiliary roller 47 becomes a transport load generation section for generating a transport load in the clamp roller 37, If such a transport load generation section exists, the roll paper P slips in the clamp roller 37 or the clamp roller 37 does not rotate a predetermined amount. Then, the clamp roller 37 is placed out of sync with the paper delivery roller 19 positioned downstream from the auxiliary roller 47 and consequently it is feared that the precise delivery operation of the roll paper P by the paper delivery roller 19 may be adversely affected, degrading the print quality.

Then, in the printer 1, the circumferential velocity of the clamp roller 37, $V_A$, is set larger than the circumferential velocity of the paper delivery roller 19, $V_C$, as described above, whereby the transport load generated in the presence of the auxiliary roller 47 and the paper delivery operation of the clamp roller 37 with the paper delivery amount slightly larger than that of the paper delivery roller 19 cancel each other. Therefore, the appropriate print quality can be provided without affecting the precise delivery operation of the roll paper P by the paper delivery roller 19. In this case, it is desirable that the circumferential velocity of the clamp roller 37, $V_A$, and the circumferential velocity of the paper delivery roller 19, $V_C$, should be determined in response to the magnitude of the transport load generated by the auxiliary roller 47.

By the way, if the circumferential velocity of the clamp roller 37, $V_A$, is larger than the circumferential velocity of the paper delivery roller 19, $V_C$, consequently the advance amount of the roll paper P advancing downward from the auxiliary roller 47 may become larger than the paper delivery amount of the paper delivery roller 19. In such a case, distortion occurs in the roll paper P in the paper passage from the auxiliary roller 47 to the paper delivery roller 19. Particularly, to continuously print on one roll R of paper, the distortion becomes a significant size and it is also feared that the distortion may cause a paper jam to occur in the paper passage.

Then, in the printer 1 according to the embodiment, a guide device for regulating the distortion of the roll paper P is placed in the paper passage from the auxiliary roller 47 to the paper delivery roller 19. In FIG. 9, the upper rear paper guide 69, the lower rear paper guide 71, the upper front paper guide 73, the lower front paper guide 74, and the paper delivery driven roller holder 18 make up the guide device. The surface and back of the roll paper P going from the auxiliary roller 47 to the paper delivery roller 19 are guided by the guide device and distortion is regulated.

Therefore, it is not feared that extreme distortion may occur in the roll paper P in the paper passage from the auxiliary roller 47 to the paper delivery roller 19, causing a paper jam to occur, and it is made possible to execute the smooth paper delivery operation. In this case, the distortion regulated by the guide device is released as the roll paper P is overdelivered downstream from the paper delivery roller 19 through a slip phenomenon in the paper delivery roller 19. Therefore, it is desirable that the difference between the advance amount of the roll paper advancing downward from the auxiliary roller 47 and the paper delivery amount of the paper delivery roller 19 should be such a difference enabling the print quality in the record head 21 to be maintained at a given level or higher.

In the embodiment, the guide device is provided for regulating the distortion of the roll paper P; however, a distortion space wherein the distortion of the roll paper P can be safely absorbed without causing a paper jam to occur may be provided at a position in the paper passage from the auxiliary roller 47 to the paper delivery roller 19. In this case, the distortion occurring in the roll paper P scarcely affects the precise delivery operation of the paper delivery roller 19 and thus it is made possible to provide the print result of still higher quality.

If the described clamp roller 37 is "first transport roller," the described paper delivery roller 19 is "second transport roller," and the described auxiliary roller 47 is "transport load generation section," it is made possible to provide the advantages described above without being limited to the configuration of the embodiment, particularly the curl correction device 2. That is, in a "transport medium delivery device" comprising "first transport roller" for clamping and transporting a transport medium, "transport load generation section" being placed in the downstream proximity of the first transport roller for giving a load to the transport medium paid out from the first transport roller, thereby generating a transport load in the first transport roller, and "second transport roller" being placed downstream from the transport load generation section for clamping and precisely delivering the transport medium downstream, if the delivery speed of the transport medium by the first transport roller is set larger than that by the second transport roller, the transport load generated by the transport load generation section and the transport medium delivery operation of the first transport roller with the delivery amount slightly larger than that of the second transport roller cancel each other, so that it is made possible to perform the appropriate transport operation without affecting the precise delivery operation of the second transport roller.

Although the invention has been described in its preferred form with a certain degree of particularity, obviously many changes and variations are possible therein. It is therefore to be understood that the present invention may be practiced than as specifically described herein without departing from the scope and sprit thereof.

What is claimed is:

1. A roll paper curl correction device comprising:

a clamp roller for clamping and transporting roll paper; and a guide member including a guide face positioned in a proximity of the clamp roller on a downstream side in transportation of the roll paper and contacting with a non-print side of the roll paper so that the roll paper is curved to an opposite side of a curl tendency of the roll paper, wherein the guide face is a curve face formed so as to be curved to the opposite side of the curl tendency of the roll paper, and wherein the curve face is formed so that a curvature radius of the roll paper becomes 15 mm or less when the roll paper passes through the curve face.

2. The roll paper curl correction device as claimed in claim 1, wherein a correction angle of the guide member is at least 75° or more.

3. A roll paper curl correction device comprising:

a clamp roller for clamping and transporting roll paper; and a guide member including a guide face positioned in a proximity of the clamp roller on a downstream side in transportation of the roll paper and contacting with a non-print side of the roll paper so that the roll paper is curved to an opposite side of a curl tendency of the roll paper, wherein:

the guide face is a peripheral surface of a guide roller disposed at a position in a roll paper transport passage in the downstream proximity of the clamp roller and the guide roller is rotatable in a direction in which the roll paper is curved to the opposite side of the curl tendency of the roll paper, and the guide face is provided upstream of a print head.

4. The roll paper curl correction device as claimed in claim 3, wherein a diameter, a position, and a rotation speed of the guide roller are determined so that the roll paper is curved to the opposite side of the curl tendency of the roll paper in a state in which the curvature radius of the roll paper becomes 10 mm or less.

5. A roll paper curl correction device comprising:

a clamp roller for clamping and transporting roll paper; and a guide member including a guide face positioned in a proximity of the clamp roller on a downstream side in transportation of the roll paper and contacting with a non-print side of the roll paper so that the roll paper is curved to an opposite side of a curl tendency of the roll paper, wherein a passage length between the clamp roller and the guide face is 8 mm or less.

6. A roll paper curl correction device for correcting curl of a roll paper unrolled from a paper roll, said roll paper curl correction device comprising:

a clamp roller for clamping and transporting the roll paper; and an auxiliary roller disposed at a position in a proximity of the clamp roller on a downstream side in transportation of the roll paper so as to contact with the roll paper paid out from the clamp roller;

wherein the auxiliary roller changes an advance direction of the roll paper to thereby form a curve condition thereof and guides the roll paper to the downstream side in transportation of the roll paper by rotating; and a circumferential velocity VB of an outer periphery of the auxiliary roller is set larger than a circumferential velocity VA of an outer periphery of the clamp roller.

7. The roll paper curl correction device as claimed in claim 6, wherein $V_B \geqq 2V_A$.

8. The roll paper curl correction device as claimed in claim 6 or 7, wherein an angle formed between the roll paper paid out from the clamp roller and the roll paper passing through the auxiliary roller makes substantially a right angle in a side view of a transport passage of the roll paper.

9. The roll paper curl correction device as claimed in claim 6, wherein the outer periphery of the auxiliary roller is formed of an elastic material.

10. The roll paper curl correction device as claimed in claim 6, wherein the auxiliary roller comes in contact with a non-print side of the roll paper.

11. A record apparatus comprising a roll paper curl correction device comprising:

a clamp roller for clamping and transporting a roll paper; and an auxiliary roller disposed at a position in a proximity of the clamp roller on a downstream side in transportation of the roll paper so as to contact with the roll paper paid out from the clamp roller;

wherein the auxiliary roller changes an advance direction of the roll paper to thereby form a curve condition thereof and guides the roll paper to the downstream side in transportation of the roll paper by rotating;

a circumferential velocity $V_B$ of an outer periphery of the auxiliary roller is set larger than a circumferential velocity $V_A$ of an outer periphery of the clamp roller.

12. A roll paper curl connection device for correcting curl of a roll paper unrolled from a paper roll, the roll paper curl correction device comprising:

a clamp roller for clamping and transporting the roll paper; and a curve formation section placed in a proximity of the clamp roller on a downstream side in transportation of the roll paper for curving the roll paper in an opposite direction to a curl tendency thereof, the clamp roller including a drive roller on which a driving force is provided; and a driven roller having a peripheral surface for coming in contact with a peripheral surface of the drive roller in a press contact state, the driven roller being operative to advance towards or retreat from the drive roller.

13. The roll paper curl correction device as claimed in claim 12, wherein the curve formation section is implemented as an auxiliary roller being placed at a position in a proximity of the clamp roller on a downstream side in transportation of the roll paper so as to abut with the roll paper paid out from the clamp roller; and the auxiliary roller changes an advance direction of the roll paper to thereby form a curve condition thereof and guides the roll paper to the downstream side in transportation of the roll paper by rotating.

14. The paper curl correction device as claimed in claim 12, wherein the driven roller is operated to move, in relation to the drive roller, by a swing frame.

15. A roll paper curl correction device for correcting a curl of a roll paper unrolled from a paper roll by a curving device for curving the roll paper in an opposite direction to the curl thereof, said roll paper curl correction device comprising:

a correction amount adjustment mechanism for adjusting a curl correction degree;

wherein the correction amount adjustment mechanism corrects a curl of a tip portion of the roll paper unrolled from the paper roll more moderately than a curl of a portion following the tip Portion of the roll paper, wherein the curving device comprises:

a clamp roller for clamping and transporting the roll paper; and a curve formation section being in a proximity of the clamp roller in a downstream side in transportation of the roll paper for curving the roll paper in the opposite direction to the curl.

16. The roll paper curl correction device as claimed in 15, wherein the curve formation section is implemented as an auxiliary roller being placed at a position in a proximity of the clamp roller on a downstream side in transportation of the roll paper so as to abut with the roll paper paid out from the clamp roller; and the auxiliary roller changes an advance direction of the roll paper to thereby form a curve condition thereof and guides the roll paper to the downstream side in transportation of the roll paper by rotating.

17. The roll paper curl correction device as claimed in claim 15, or 16, wherein the clamp roller includes a drive roller on which a driving force is provided; and a driven roller having a peripheral surface for coming in contact with a peripheral surface of the drive roller in a press contact state, the driven roller being operative to advance towards or retreat from the drive roller.

18. The roll paper curl correction device as claimed in claim 17, wherein the driven roller is operated to move, in relation to the drive roller, by a swing frame.

19. A roll paper curl correction device for correcting a curl of a roll paper unrolled from a paper roll by a curving device for curving the roll paper in an opposite direction to the curl thereof, said roll namer curl correction device comprising:

a correction amount adjustment mechanism for adjusting a curl correction degree;

wherein the correction amount adjustment mechanism corrects a curl of a tip portion of the roll paper unrolled from the paper roll more moderately than a curl of a portion following the tip portion of the roll paper, and wherein a velocity $V_{A1}$ at which the tip portion of the roll paper passes through the curving device is set to be larger than a velocity $VA_2$ at which the portion following the tip portion of the roll paper passes through the curving device, so that the correction amount adjustment mechanism corrects the curl of the tip portion of the roll paper more moderately than the curl of the portion following the tip portion of the roll paper.

20. A roll paper curl correction device for correcting a curl of a roll paper unrolled from a paper roll by a curving device for curving the roll paper in an opposite direction to the curl thereof, said roll paper curl correction device comprising:

a correction amount adjustment mechanism for adjusting a curl correction degree;

wherein the correction amount adjustment mechanism corrects a curl of a tip portion of the roll paper unrolled from the paper roll more moderately than a curl of a portion following the tip portion of the roll paper, and wherein a curvature $R_1$ when the tip portion of the roll paper passes through the curving device is set to be larger than a curvature $R_2$ when the portion following the tip portion of the roll paper passes through the curving device, so that the correction amount adjustment mechanism corrects the curl of the tip portion of the roll paper more moderately than the curl of the portion following the tip portion of the roll paper.

21. A record apparatus comprising a roll paper curl correction device and being capable of recording on roll paper, the roll paper curl correction device for correcting curl of roll paper unrolled from a paper roll, the roll paper curl correction device including a clamp roller for clamping and transporting the roll paper; and a curve formation section placed in a proximity of the clamp roller on a downstream side in transportation of the roll paper for curving the roll paper in an opposite direction to a curl tendency thereof, wherein the clamp roller includes a drive roller on which a driving force is provided; and a driven roller having a peripheral surface for coming in contact with a peripheral surface of the drive roller in a press contact state, the driven roller being operative to advance towards or retreat from the drive roller.

22. The record apparatus as claimed in claim 21, wherein the driven roller is operated to move, in relation to the drive roller, by a swing frame.

23. A roll paper curl correction device comprising:

a clamp roller for clamping and transporting roll paper; and a guide member including a guide face positioned in a proximity of the clamp roller on a downstream side in transportation of the roll paper and contacting with a non-print side of the roll paper so that the roll paper is curved to an opposite side of a curl tendency of the roll paper, wherein the guide member does not contact a print side of the roll paper.

24. A record apparatus comprising a roll paper curl correction device, the roll paper curl correction device including a clamp roller for clamping and transporting a roll paper; and a guide member including a guide face positioned in a proximity of the clamp roller on a downstream side in transportation of the roll paper and formed so that the roll paper is curved to an opposite side of a curl tendency of the roll paper for coming in contact with a non-print side of the paper roll, wherein the guide member does not contact a print side of the roll paper.

* * * * *